US008887329B2

(12) United States Patent
Soltani

(10) Patent No.: US 8,887,329 B2
(45) Date of Patent: Nov. 18, 2014

(54) METHODS OF TRANSLATING HOSPITAL CHAIR BEDS WITH ARTICULATING FOOT SECTIONS

(71) Applicant: Piedmont 361, LLC, Dobson, NC (US)

(72) Inventor: Sohrab Soltani, Charleston, SC (US)

(73) Assignee: Piedmont 361, LLC, Dobson, NC (US)

( * ) Notice: Subject to any disclaimer, the term of this patent is extended or adjusted under 35 U.S.C. 154(b) by 0 days.

(21) Appl. No.: 13/933,840

(22) Filed: Jul. 2, 2013

(65) Prior Publication Data

US 2013/0291305 A1 Nov. 7, 2013

Related U.S. Application Data

(62) Division of application No. 12/558,187, filed on Sep. 11, 2009, now Pat. No. 8,495,774.

(60) Provisional application No. 61/096,572, filed on Sep. 12, 2008, provisional application No. 61/183,117, filed on Jun. 2, 2009.

(51) Int. Cl.

| | |
|---|---|
| ***A61G 7/00*** | (2006.01) |
| ***A61G 7/16*** | (2006.01) |
| ***A61G 7/053*** | (2006.01) |
| ***A61G 7/10*** | (2006.01) |
| *A61G 7/012* | (2006.01) |
| *A61G 7/015* | (2006.01) |
| *A61G 7/05* | (2006.01) |

(52) U.S. Cl.

CPC *A61G 7/16* (2013.01); *A61G 7/053* (2013.01); *A61G 7/1076* (2013.01); *A61G 7/012* (2013.01); *A61G 7/015* (2013.01); *A61G 2007/0509* (2013.01); *A61G 2007/0513* (2013.01)

USPC ..... 5/618; 5/624; 5/648; 5/178; 5/661

(58) Field of Classification Search

USPC ..... 5/618, 619, 624, 648–651, 178, 661

See application file for complete search history.

(56) References Cited

U.S. PATENT DOCUMENTS

| | | | | |
|---|---|---|---|---|
| RE10,906 | E * | 3/1888 | Case | 297/69 |
| 487,625 | A | 12/1892 | Kales | |
| 488,649 | A | 12/1892 | Daggett | |
| 712,671 | A | 11/1902 | Haller | |
| 890,407 | A | 6/1908 | Colles | |

(Continued)

FOREIGN PATENT DOCUMENTS

| | | | |
|---|---|---|---|
| JP | 08-308886 | A | 11/1996 |
| JP | 09-010264 | A | 1/1997 |
| KR | 10-0621350 | B1 | 9/2006 |

OTHER PUBLICATIONS

Notification of Transmittal of the International Search Report and the Written Opinion of the International Searching Authority issued by the Korean Intellectual Property Office on Mar. 31, 2010 for corresponding PCT Application No. PCT/US2009/056681.

*Primary Examiner* — William Kelleher

(74) *Attorney, Agent, or Firm* — Myers Bigel Sibley & Sajovec

(57) ABSTRACT

A hospital bed includes a base, a lifting mechanism, a rotating frame configured to rotate horizontally relative to the base, and a patient support surface pivotally secured to the rotating frame. The patient support surface includes a back section, a seat section, and foot section that articulate relative to each other. The patient support surface translates from a bed configuration to a side-egress chair configuration. The foot section includes a plurality of panels that translate relative to each other from a substantially co-planar relationship when the patient support surface is in a bed configuration to a relationship where one of the foot section panels is substantially orthogonal to another foot section panel when the patient support surface is in a chair configuration. A mattress supported by the patient support surface has a retractable foot portion that adjusts its length in response to translation of the foot section panels.

8 Claims, 37 Drawing Sheets

(56) References Cited

U.S. PATENT DOCUMENTS 924,626 A 6/1909 Arnold
2,042,399 A 5/1936 Holme
RE21,972 E 12/1941 Demcak
2,283,549 A 5/1942 Galbraith
2,452,366 A 10/1948 Freund
2,475,003 A 7/1949 Black
2,682,913 A * 7/1954 Manternach ..... 297/87
3,053,568 A 9/1962 Miller
3,210,779 A 10/1965 Herbold
3,215,469 A 11/1965 Wamsley
3,233,255 A 2/1966 Propst
3,237,212 A 3/1966 Hillenbrand et al.
3,336,606 A 8/1967 Beitzel
3,754,749 A 8/1973 Lyon et al.
4,227,269 A 10/1980 Johnston
4,551,872 A 11/1985 Reed
4,613,997 A 9/1986 Langdale
4,638,519 A 1/1987 Hess
4,648,389 A 3/1987 Kowalski et al.
4,669,136 A 6/1987 Waters et al.
4,847,929 A 7/1989 Pupovic
4,858,260 A * 8/1989 Failor et al. ..... 5/618
4,862,529 A * 9/1989 Peck ..... 5/611
4,899,403 A 2/1990 Yamasaki
4,926,457 A 5/1990 Poehner et al.
5,033,793 A 7/1991 Quintile
5,060,636 A 10/1991 Bell
5,072,463 A 12/1991 Willis
5,133,097 A 7/1992 Pyles
5,138,729 A 8/1992 Ferrand
5,230,113 A 7/1993 Foster et al.
5,279,010 A 1/1994 Ferrand et al.
5,369,825 A 12/1994 Reesby
5,377,370 A 1/1995 Foster et al.
5,454,126 A 10/1995 Foster et al.
5,469,588 A 11/1995 DiMatteo et al.
5,479,666 A 1/1996 Foster et al.
5,537,701 A 7/1996 Elliott
5,564,438 A 10/1996 Merchant
5,715,548 A 2/1998 Weismiller et al.
5,778,467 A 7/1998 Scott et al.
5,784,734 A 7/1998 Scott et al.
5,791,001 A 8/1998 Wang
5,794,286 A 8/1998 Scott et al.
5,906,016 A 5/1999 Ferrand et al.
5,906,017 A 5/1999 Ferrand et al.
6,076,208 A 6/2000 Heimbrock et al.
6,182,316 B1 2/2001 Thomas et al.
6,202,230 B1 3/2001 Borders
6,202,231 B1 3/2001 Heimbrock et al.
6,212,714 B1 4/2001 Allen et al.
6,272,702 B1 8/2001 Uchida et al.
6,315,319 B1 11/2001 Hanson et al.
6,427,264 B1 8/2002 Metz et al.
6,446,287 B2 9/2002 Borders
6,496,993 B2 12/2002 Allen et al.
6,565,112 B2 5/2003 Hanson et al.
6,578,219 B1 6/2003 Gabel et al.
6,584,629 B2 7/2003 Tsuji et al.
6,611,979 B2 9/2003 Welling et al.
6,658,680 B2 12/2003 Osborne et al.
6,684,427 B2 2/2004 Allen et al.
6,694,548 B2 2/2004 Foster et al.
6,704,954 B2 3/2004 Metz et al.
6,726,279 B1 4/2004 Figel et al.
6,766,547 B1 7/2004 Lagassey
6,792,633 B1 * 9/2004 Ito ..... 5/618
6,862,762 B1 * 3/2005 Johnson et al. ..... 5/601
6,880,189 B2 4/2005 Welling et al.
6,910,236 B2 6/2005 Rene
6,912,749 B2 7/2005 Thomas et al.
6,957,461 B2 10/2005 Osborne et al.
6,983,499 B2 1/2006 Gladney
7,000,272 B2 2/2006 Allen et al.
7,017,208 B2 3/2006 Weismiller et al.
7,107,636 B2 9/2006 Metz et al.
7,171,708 B2 2/2007 Osborne et al.
7,171,709 B2 2/2007 Weismiller
7,216,384 B2 5/2007 Allen et al.
7,228,579 B2 * 6/2007 Tidwell ..... 5/624
7,234,178 B2 6/2007 Qi
7,287,289 B1 10/2007 Hagopian
7,458,119 B2 12/2008 Hornbach et al.
7,788,748 B2 9/2010 Wurdeman
2001/0000363 A1 * 4/2001 Borders ..... 5/618
2001/0029628 A1 10/2001 Ferrand et al.
2002/0002742 A1 1/2002 Osborne et al.
2002/0066142 A1 6/2002 Osborne et al.
2002/0170113 A1 11/2002 Metz et al.
2002/0170115 A1 11/2002 Borders et al.
2002/0170116 A1 * 11/2002 Borders et al. ..... 5/600
2003/0061661 A1 4/2003 Borders et al.
2003/0088920 A1 5/2003 Allen et al.
2003/0093860 A1 5/2003 Kramer et al.
2003/0093863 A1 5/2003 Grove
2004/0034931 A1 * 2/2004 Kummer et al. ..... 5/424
2004/0172753 A1 9/2004 Metz et al.
2004/0177445 A1 9/2004 Osborne et al.
2004/0205895 A1 * 10/2004 Ito ..... 5/618
2004/0231052 A1 11/2004 Gladney
2004/0231056 A1 11/2004 Jansen
2005/0138731 A1 * 6/2005 Failor et al. ..... 5/601
2005/0144724 A1 7/2005 Petric
2005/0172405 A1 8/2005 Menkedick et al.
2006/0000022 A1 1/2006 Dewert
2006/0006724 A1 * 1/2006 Shimizu ..... 297/423.26
2006/0021142 A1 2/2006 Hornbach et al.
2006/0026762 A1 2/2006 Hornbach et al.
2006/0075560 A1 4/2006 Osborne et al.
2006/0085914 A1 4/2006 Peterson et al.
2006/0096029 A1 5/2006 Osborne et al.
2006/0150332 A1 7/2006 Weismiller et al.
2006/0162079 A1 7/2006 Menkedick et al.
2006/0168728 A1 8/2006 Strobel et al.
2006/0168729 A1 8/2006 Weismiller et al.
2006/0168730 A1 8/2006 Menkedick et al.
2006/0168731 A1 8/2006 Menkedick et al.
2006/0191073 A1 8/2006 Honda
2006/0253982 A1 11/2006 Kummer et al.
2007/0017029 A1 * 1/2007 Wurdeman ..... 5/618
2007/0089238 A1 4/2007 Kramer et al.
2007/0136949 A1 6/2007 Richards et al.
2007/0157385 A1 7/2007 Lemire et al.
2007/0169268 A1 7/2007 Lemire et al.
2007/0174964 A1 8/2007 Lemire et al.
2007/0174965 A1 8/2007 Lemire et al.
2007/0174967 A1 * 8/2007 Bourgraf et al. ..... 5/618
2007/0174968 A1 8/2007 Barthelt
2007/0180618 A1 8/2007 Weismiller et al.
2007/0180626 A1 8/2007 Ellis et al.
2007/0289063 A1 12/2007 Martin et al.
2007/0289064 A1 12/2007 Martin et al.
2008/0010748 A1 1/2008 Menkedick et al.
2008/0052831 A1 3/2008 Weismiller et al.
2008/0092292 A1 4/2008 Rawls-Meehan
2008/0092293 A1 4/2008 Rawls-Meehan
2008/0092294 A1 4/2008 Rawls-Meehan
2008/0109959 A1 5/2008 Rawls-Meehan
2008/0115272 A1 5/2008 Rawls-Meehan
2008/0115273 A1 5/2008 Rawls-Meehan
2008/0115274 A1 5/2008 Rawls-Meehan
2008/0115275 A1 5/2008 Rawls-Meehan
2008/0115276 A1 5/2008 Rawls-Meehan
2008/0115277 A1 5/2008 Rawls-Meehan
2008/0115278 A1 5/2008 Rawls-Meehan
2008/0115279 A1 5/2008 Rawls-Meehan
2008/0115280 A1 5/2008 Rawls-Meehan
2008/0115281 A1 5/2008 Rawls-Meehan
2008/0115282 A1 5/2008 Rawls-Meehan
2012/0117732 A1 * 5/2012 O'Keefe ..... 5/613

* cited by examiner

METHODS OF TRANSLATING HOSPITAL CHAIR BEDS WITH ARTICULATING FOOT SECTIONS

RELATED APPLICATIONS

This application is a divisional application of pending U.S. patent application Ser. No. 12/558,187, filed Sep. 11, 2009, which claims the benefit of and priority to U.S. Provisional Patent Application No. 61/096,572, filed Sep. 12, 2008, and to U.S. Provisional Patent Application No. 61/183,117, filed Jun. 2, 2009, the disclosures of which are incorporated herein by reference as if set forth in their entireties.

FIELD OF THE INVENTION

The present invention relates generally to the field of hospital beds and, more specifically, to hospital beds that are convertible into a chair configuration.

BACKGROUND

Conventional hospital beds are configured to provide a sufficiently comfortable support surface for patients in a supine position. In many cases, it is desirable for patients to elevate from a supine position to a sitting position in order to increase the activity of the circulatory and cardiovascular systems and/or in the course of medical treatment. In addition, patients may be interested in sitting up in bed to be more comfortable, for example, in order to read or meet with visitors. However, it may be difficult for some patients to get out of a hospital bed. As such, hospital beds that can be converted into chair-like configurations have been developed. In addition, hospital beds that can assist patients in moving from a supine position to a sitting position for the purpose of achieving a standing or walking position have also been developed.

SUMMARY

According to some embodiments of the present invention, a hospital bed that can be converted to a chair configuration includes a base having opposite end portions, a lifting mechanism secured to the base between the end portions, and a patient support surface pivotally secured to the lifting mechanism. The patient support surface is configured to support a mattress thereon. The lifting mechanism is configured to raise the patient support surface and mattress relative to the base to a stand-assist configuration to facilitate egress by a patient.

The patient support surface includes a back section, a seat section, and foot section that are configured to articulate relative to each other, and the patient support surface is configured to translate from a bed configuration to a chair configuration. The foot section includes a plurality of panels that are configured to translate relative to each other from a substantially co-planar relationship when the patient support surface is in a bed configuration to a relationship where one of the foot section panels is substantially orthogonal to another foot section panel when the patient support surface is in a chair configuration. The mattress has a retractable foot portion that adjusts its length in response to translation of the foot section panels.

According to some embodiments of the present invention, a hospital bed that can be converted to a chair configuration includes a base having opposite end portions, a lifting mechanism secured to the base between the end portions, a rotating frame mounted on the lifting mechanism that is configured to rotate horizontally relative to the base, and a patient support surface pivotally secured to the rotating frame. The patient support surface is configured to support a mattress thereon. The lifting mechanism is configured to raise the patient support surface and mattress relative to the base to a stand-assist configuration to facilitate egress by a patient.

The patient support surface includes a back section, a seat section, and foot section that are configured to articulate relative to each other, and the patient support surface is configured to translate from a bed configuration to a side-egress chair configuration. The foot section includes a plurality of panels that are configured to translate relative to each other from a substantially co-planar relationship when the patient support surface is in a bed configuration to a relationship where one of the foot section panels is substantially orthogonal to another foot section panel when the patient support surface is in a chair configuration. The mattress has a retractable foot portion that adjusts its length in response to translation of the foot section panels.

In some embodiments of the present invention, a pair of side rails are movably mounted to opposite side portions of the back section. Each of these side rails is movable between raised and lowered positions relative to the back section. A pair of side rails also may be movably mounted to opposite side portions of the foot section. Each of these side rails is movable between raised and lowered positions relative to the foot section and define exit handrails when the bed is in a side egress position.

In some embodiments of the present invention, the foot section comprises first and second panels operably connected together. When the patient support surface is in a chair configuration, the first and second foot section panels are substantially orthogonal to each other and a portion of the second panel extends beneath the base.

In some embodiments of the present invention, the foot section includes a plurality of panels pivotally connected together in series. The plurality of foot section panels are configured to overlap each other when the patient support surface is in a chair configuration so that at least two of the foot section panels are in a substantially horizontal orientation.

In some embodiments of the present invention, the foot section includes first, second, and third panels pivotally connected together in series. The foot section first panel is pivotally connected to the seat section, and the first second and third panels pivot relative to each other such that, when the patient support surface is in a chair configuration, the third panel is substantially horizontal, the second panel is in overlying, face-to-face contact with the third panel, and the first panel is substantially vertical. In addition, the foot section first, second and third panels pivot relative to each other such that, when the patient support surface is in a chair configuration, a portion of the third panel extends beneath the base of the bed. The foot section first, second, and third panels each have respective different lengths. In some embodiments, the foot section first panel has a length that is greater than a length of the second and third panels. In other embodiments, the foot section second panel has a length that is less than a length of the first and third panels. In yet further embodiments, the foot section third panel has a length that is greater than a length of the second panel and that is less than a length of the first panel.

According to other embodiments of the present invention, a method of translating a hospital bed to a chair configuration includes articulating the back, seat and foot sections of a patient support surface relative to each other from a substantially co-planar configuration to a chair configuration; and translating foot section panels so that one of the foot section panels is substantially orthogonal to another foot section panel. In some embodiments, the foot section includes first and second panels, and the translating step includes translating the first and second foot section panels to be substantially orthogonal to each other. In other embodiments, the foot section includes a plurality of panels pivotally connected together in series, and the translating step includes translating the foot section panels such that at least two of the foot section panels are in a substantially horizontal orientation. In some embodiments, the translating step may include translating one of the foot section panels such that a portion of the foot section panel extends beneath a base of the bed.

When the bed is in a chair configuration, the patient support surface may be raised to a stand-assist egress configuration to facilitate egress by a patient from the foot end of the bed. In some embodiments, the seat section may be tilted downwardly as the patient support surface is raised.

In some embodiments, patient side rails may be rotated with the back, seat and foot sections when the bed is in an egress configuration and then tilted downwardly toward a floor.

According to other embodiments of the present invention, a method of translating a hospital bed to a side egress configuration includes articulating the back, seat and foot sections of a patient support surface relative to each other from a substantially co-planar configuration to a chair configuration, rotating the back, seat and foot sections 90 degrees to a side egress position; and translating foot section panels so that one of the foot section panels is substantially orthogonal to another foot section panel. In some embodiments, the foot section includes first and second panels, and the translating step includes translating the first and second foot section panels to be substantially orthogonal to each other. In other embodiments, the foot section includes a plurality of panels pivotally connected together in series, and the translating step includes translating the foot section panels such that at least two of the foot section panels are in a substantially horizontal orientation. In some embodiments, the translating step may include translating one of the foot section panels such that a portion of the foot section panel extends beneath a base of the bed.

When the bed is in a side egress configuration, the patient support surface may be raised to a stand-assist side egress configuration to facilitate egress by a patient. In some embodiments, the seat section may be tilted downwardly as the patient support surface is raised.

In some embodiments, patient side rails may be rotated with the back, seat and foot sections when the bed is in a side egress configuration and then tilted downwardly toward a floor.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying drawings, which form a part of the specification, illustrate embodiments of the present invention. The drawings and description together serve to fully explain the invention.

DETAILED DESCRIPTION

Figure 1:
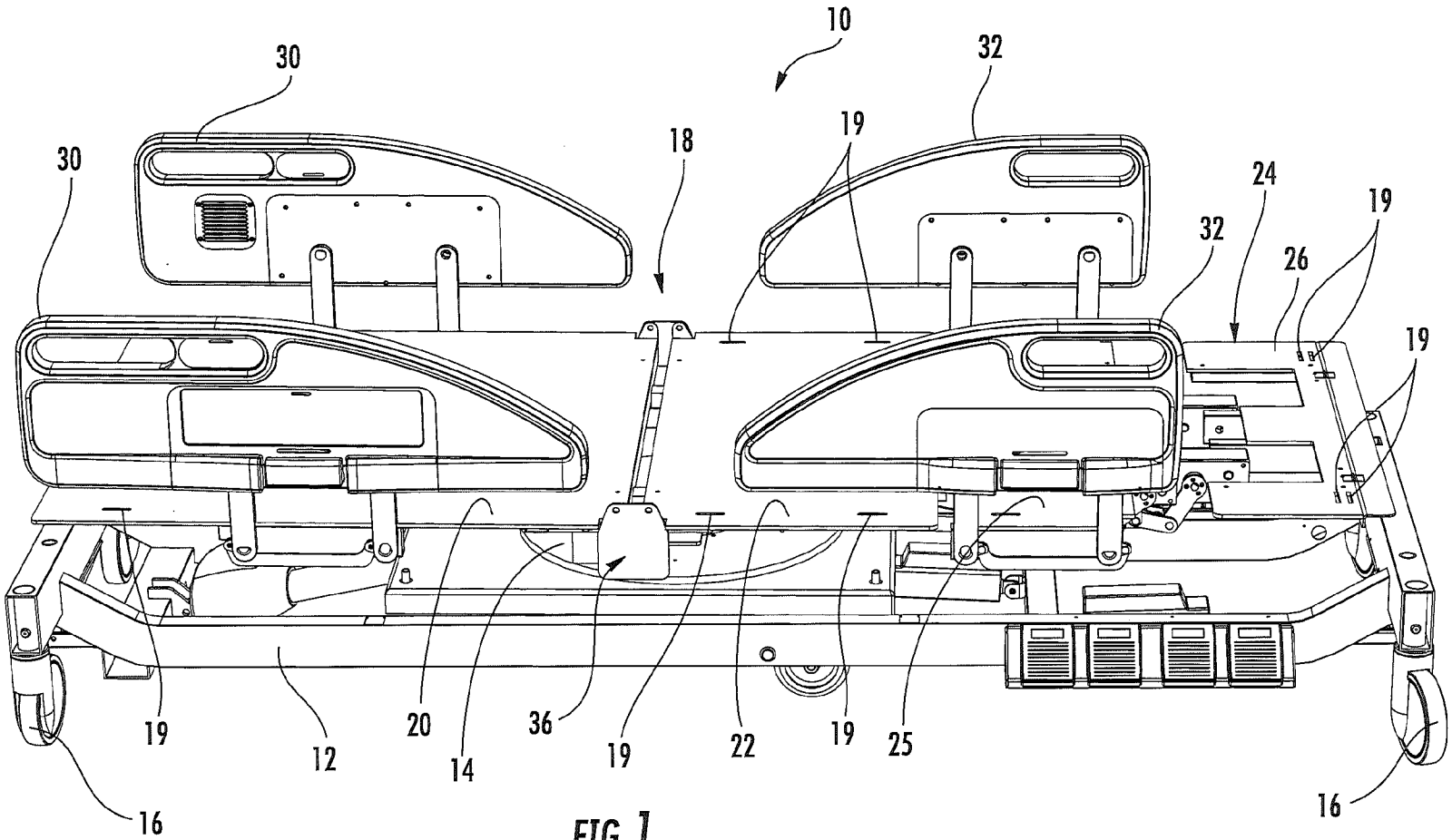
FIGS. 1 and 2 are top perspective views of a hospital chair bed in the bed configuration, according to some embodiments of the present invention.
Figure 2:
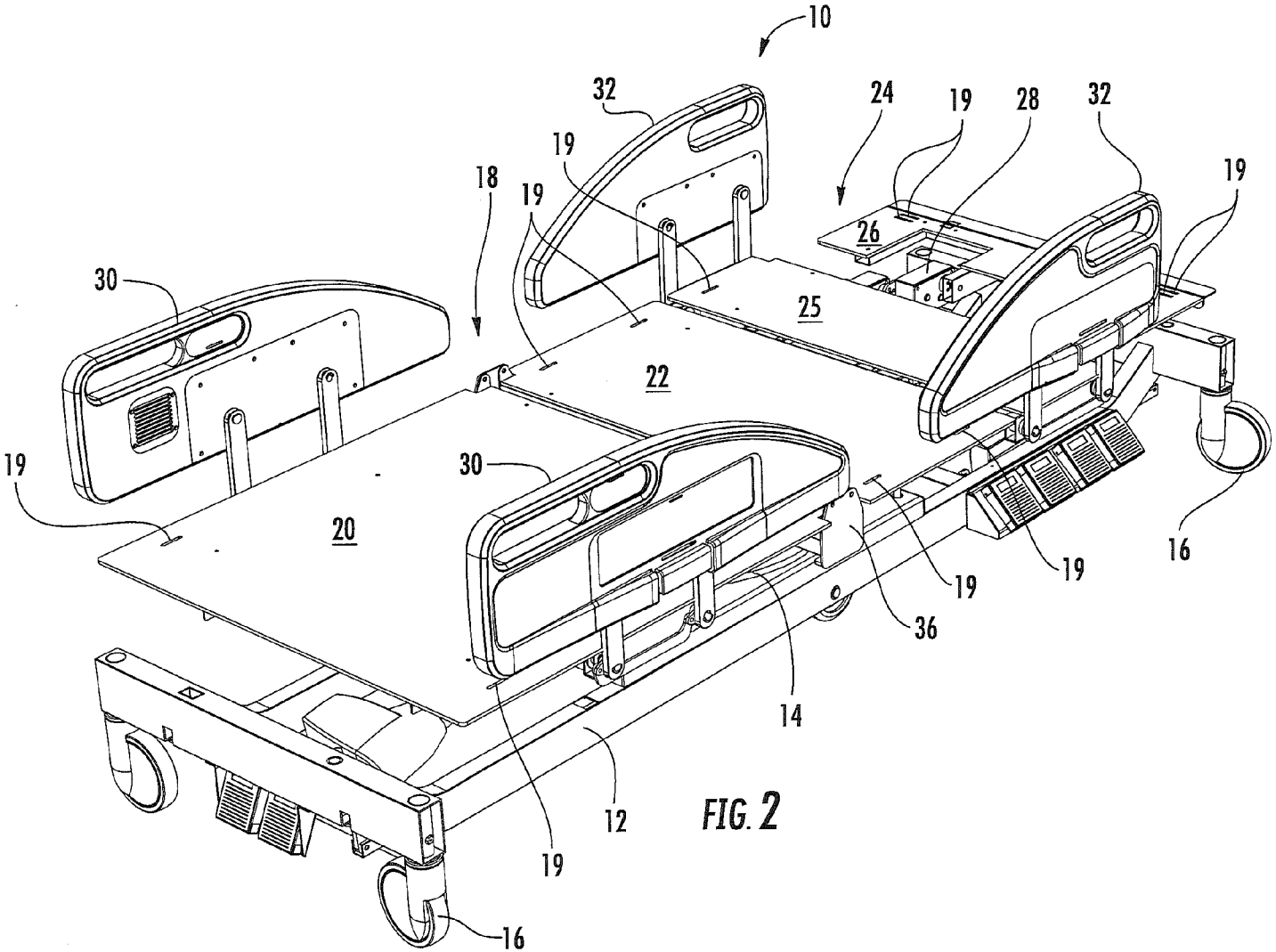

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification are taken to specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

In the drawings, the thickness of lines, layers and regions may be exaggerated for clarity. It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". A device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a "first" element, component, region, layer or section discussed below could also be termed a "second" element, component, region, layer or section without departing from the teachings of the present invention.

Referring to FIGS. 1-9, a hospital bed 10, according to some embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 are mounted to the four corners of the base 12 and facilitate movement of the bed about the hospital or other environment. In some embodiments, casters 16 are locking casters that can be selectively locked to prevent movement of the bed 10.

The illustrated bed 10 has a patient support surface 18 configured to support a mattress (FIGS. 11A-11I) on which a patient is situated. The patient support surface 18 is supported by the rotating frame 14 and includes a back section 20, a seat section 22, and a foot section 24. The back section 20, seat section 22 and foot section 24 can articulate with respect to each other and can be serially hinged or otherwise movably secured together, as illustrated. The back section 20 and seat section 22 can be pivotally attached to each other by pins, hinges, or other suitable mechanisms well known in the art. The seat section 22 and foot section 24 can also be pivotally attached to each other by pins, hinges, or other suitable mechanisms well known in the art.

In some embodiments, hospital bed 10 may have a patient support surface 18 that can be articulated into a chair configuration without rotating to a side egress position. For example, the patient support surface 18 articulates as described herein to a chair configuration such that a patient can egress from the foot of the bed 10.

Still referring to FIGS. 1-9, the illustrated bed 10 also has a first set of patient side rails 30 typically secured to the back section 20 in spaced-apart relationship and a second set of patient side rails 32 typically secured to the seat section 22 or foot section 24 in spaced-apart relationship, as illustrated. A head board 40 (FIG. 9) can be secured to the base 12 at the head end of the bed 10 and a foot board 42 (FIG. 9) can be secured to the base 12 at the foot end of the bed 10, as would be understood by those skilled in the art.

The patient support surface 18 can be secured to the rotating frame 14 in various ways, for example via a transverse rod or pin connection 36 to facilitate tilting of the patient support surface 18 relative to the rotating frame 14. The rotating frame 14 is secured to the base 12 via a lift mechanism 50 (FIGS. 3-9) such as a double scissors lift. The lift mechanism 50 is configured to raise and lower the patient support surface, via the rotating frame 14, relative to the base 12. The lift mechanism 50 can be driven by hydraulic cylinders, air cylinders, air bags, and/or electrical or electromechanical devices, etc. The lift mechanism 50 can be configured to allow the patient support surface 18 to be raised relatively high relative to the base 12 and to be lowered relatively low with respect to the base 12, as described above. See, e.g., copending U.S. patent application Ser. No. 11/398,098 for examples of rotational and lift components, which is incorporated herein by reference in its entirety.

Figure 7:
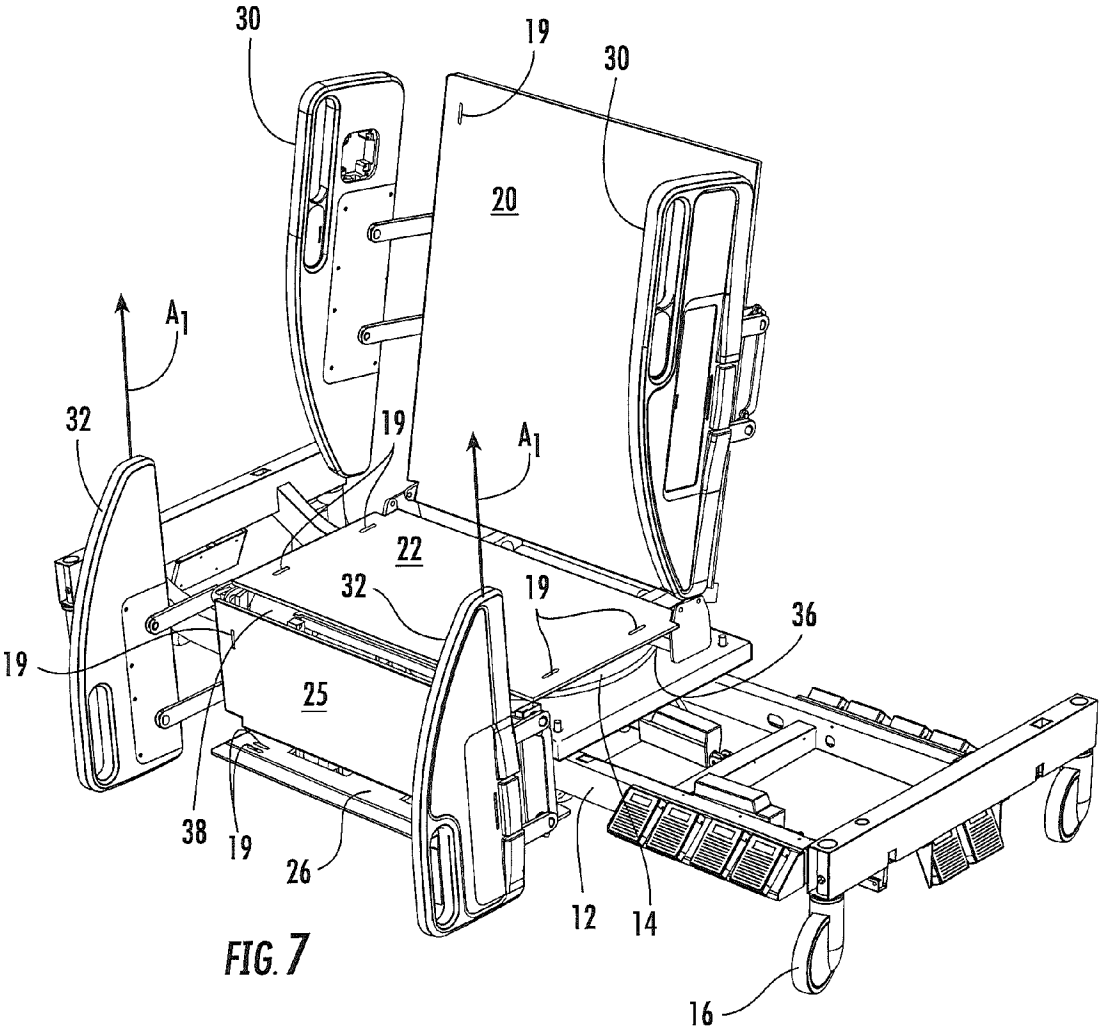

The foot section 24 may also be referred to as a leg section. Thus, the terms "foot section" and "leg section" are intended to be interchangeable. The illustrated foot section 24 includes a first panel 25 and a second panel 26 operably connected together, as illustrated. The foot section first panel 25 is pivotally connected to the seat section 22 of the articulating patient support surface 18, for example, via one or more hinges 38 (FIG. 7). When the patient support surface 18 is in a horizontal configuration to support a patient in a supine position, the foot section first and second panels 25, 26 can be in substantially co-planar relationship as illustrated in FIG. 1. The foot section panels 25, 26 are configured to articulate relative to each other so as to be substantially perpendicular to each other and such that the foot section second panel 26 is out of the way of a patient's feet when the patient support surface 18 is in a chair configuration, as illustrated in FIG. 7.

Figure 3:
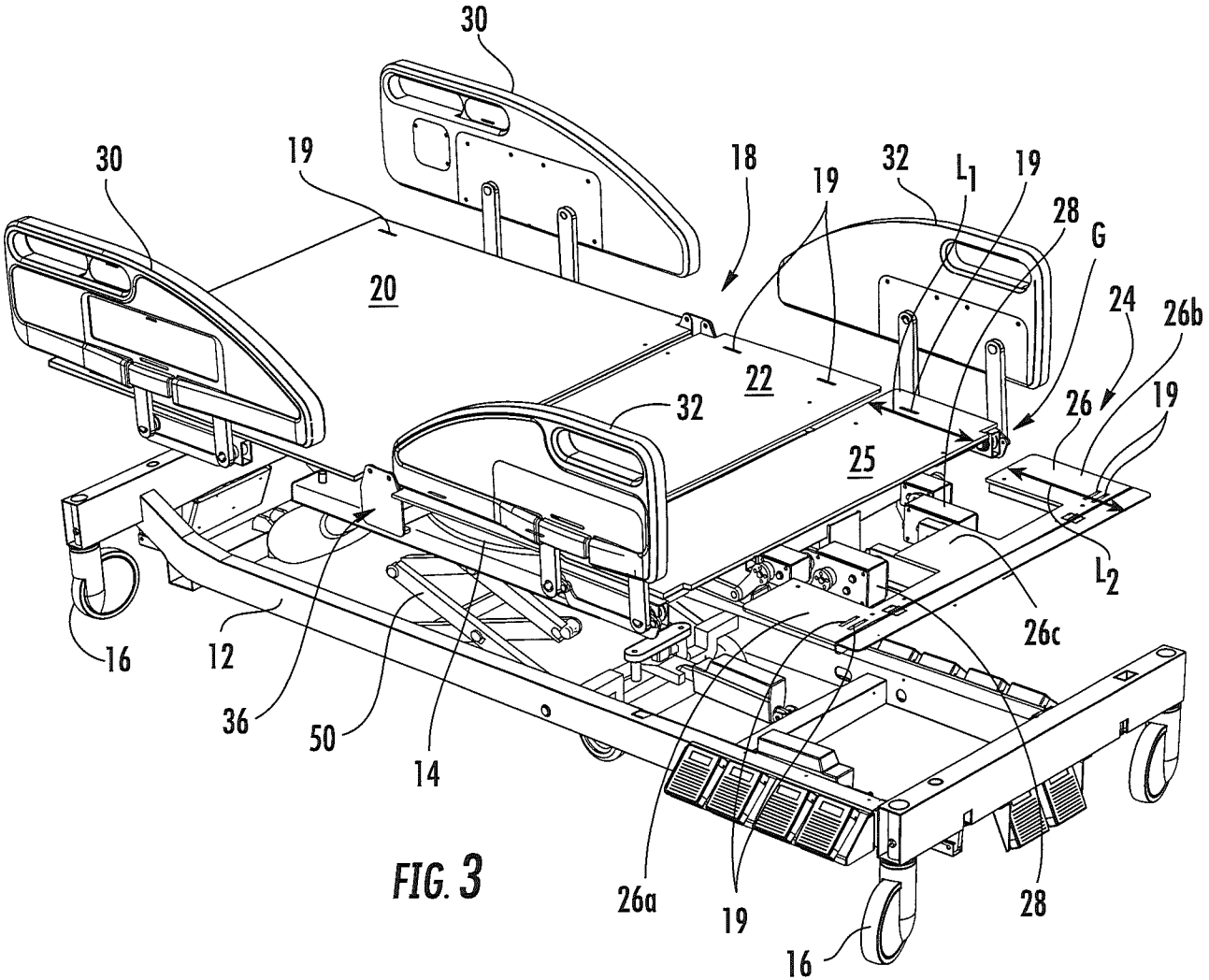
FIGS. 3-8 are perspective views of the hospital chair bed of FIGS. 1 and 2, that illustrate the transformation of the hospital chair bed from the bed configuration to a chair configuration, according to some embodiments of the present invention.
Figure 4:
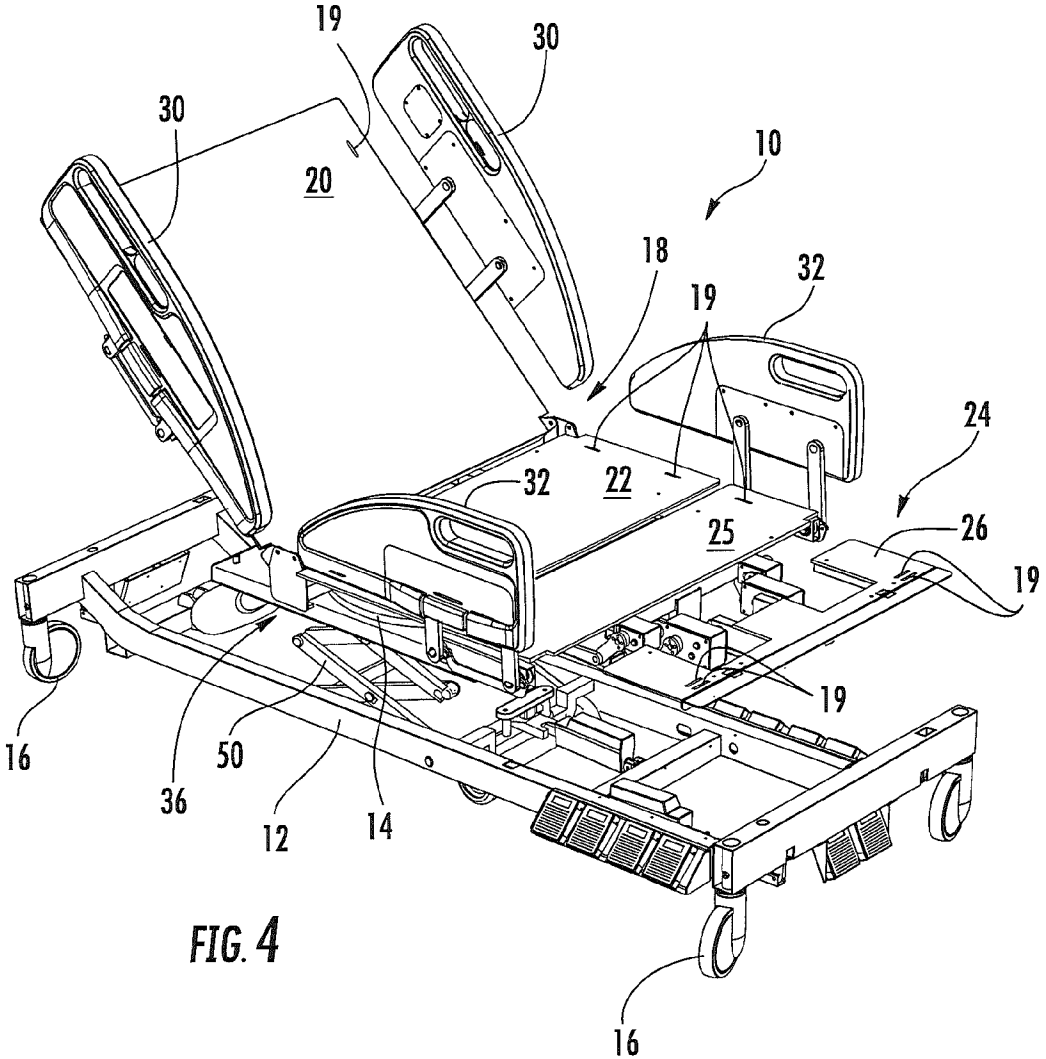

As illustrated in FIG. 3, the foot section panels 25, 26 have respective different lengths $L_1$, $L_2$. The length $L_1$ of panel 25 is greater than the length $L_2$ of panel 26 in the illustrated embodiment. $L_1$ may be between about twelve inches and about twenty four inches (12"-24"). $L_2$ may be between about six inches and about twelve inches (6"-12"). However, embodiments of the present invention are not limited to these lengths for foot section panels 25, 26. Other lengths are possible, as well.

In the illustrated embodiment, foot section first panel 25 has a generally rectangular configuration and is spaced apart from foot section second panel when the patient support surface 18 is in a bed configuration. In other words, there is a gap G between adjacent edges of the foot section first and second panels 25, 26, as illustrated in FIG. 3. Gap G may be about ten inches (10") or less. In some embodiments, gap G may be about six inches (6") or less. However, embodiments of the present invention are not limited to a particular dimension for gap G.

The foot section second panel 26 has an E-shape with opposite end portions 26*a*, 26*b* and a medial portion 26*c* located between end portions 26*a*, 26*b*. The foot section second panel 26 is operably attached to the foot section first panel 25 via the medial portion 26*c*. Gears and/or linkages (collectively indicated as 28) are used to articulate the foot section first and second panels 25, 26 relative to each other in a conventional manner. Foot section second panel 26 may have various other shapes and may have various cutouts to accommodate various linkages connecting the foot section first and second panels 25, 26, as well.

Figure 10A:
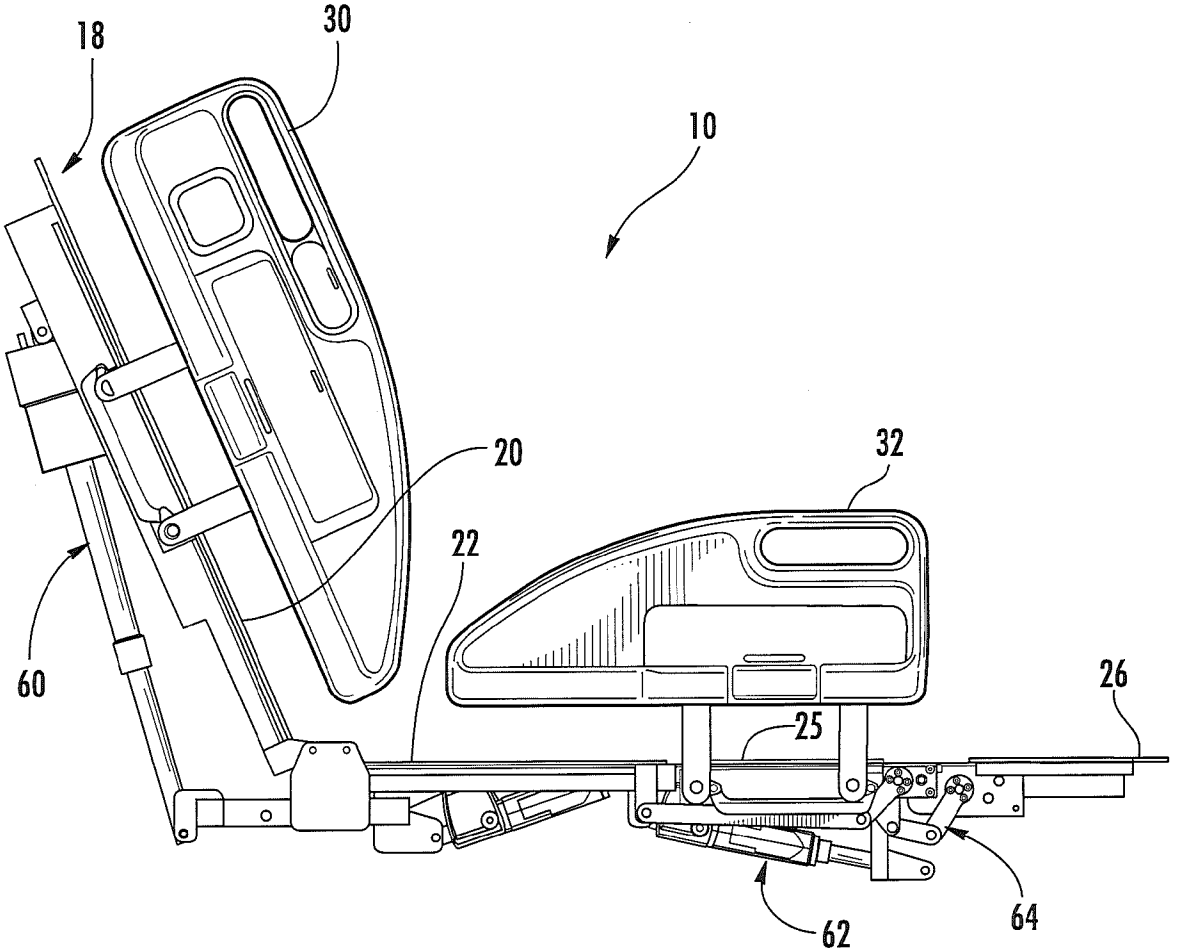
FIGS. 10A-10C are side views of the hospital chair bed of FIGS. 1 and 2 illustrating the translation of patient support surface from a substantially co-planar configuration to a chair configuration, according to some embodiments of the present invention.
Figure 10B:
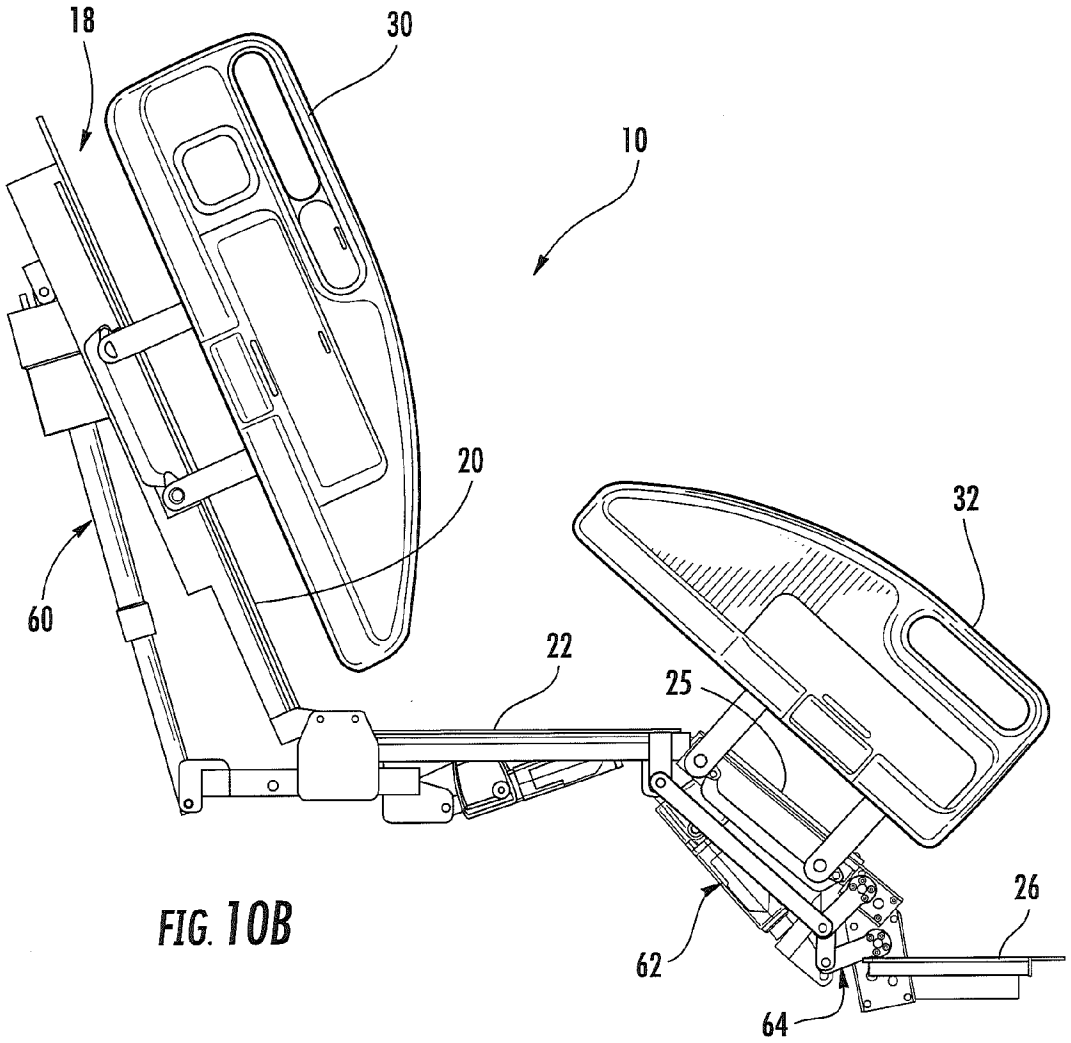
Figure 10C:
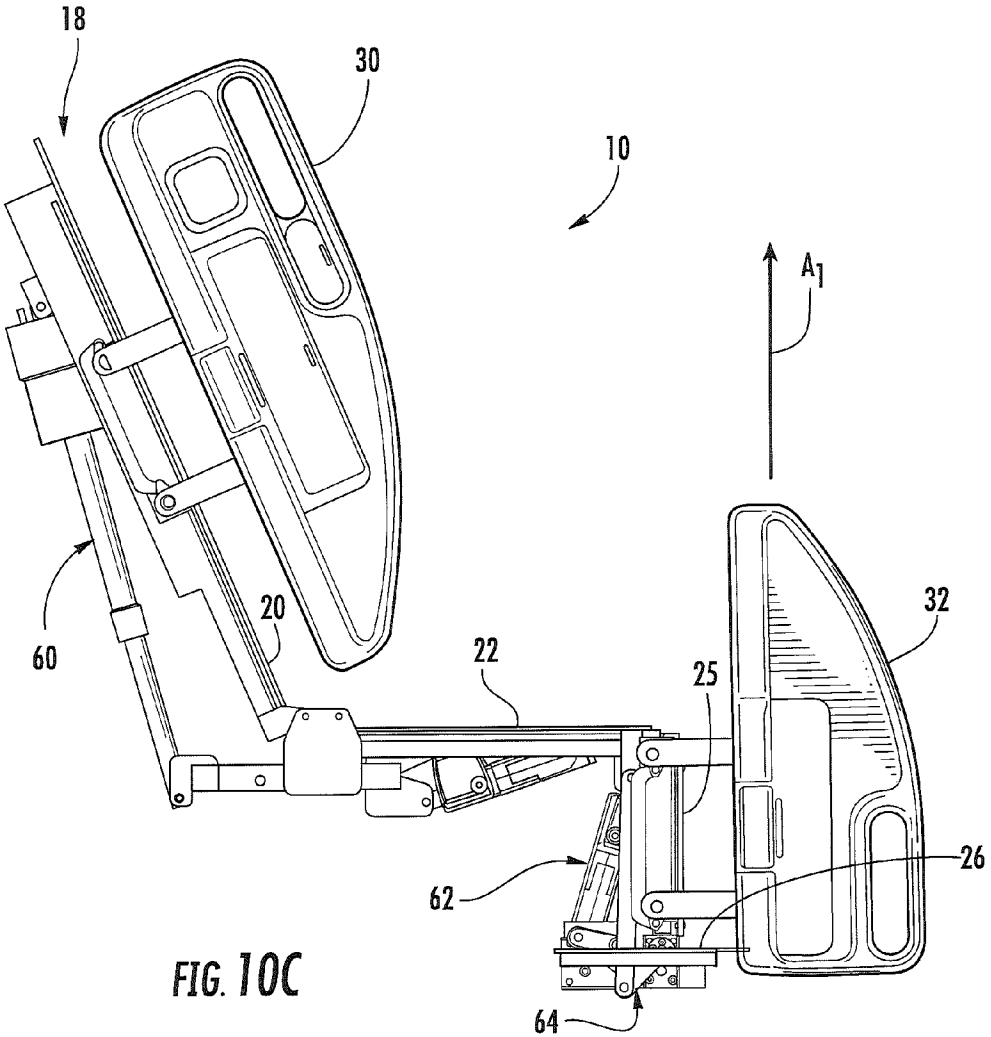
Figure 11A:
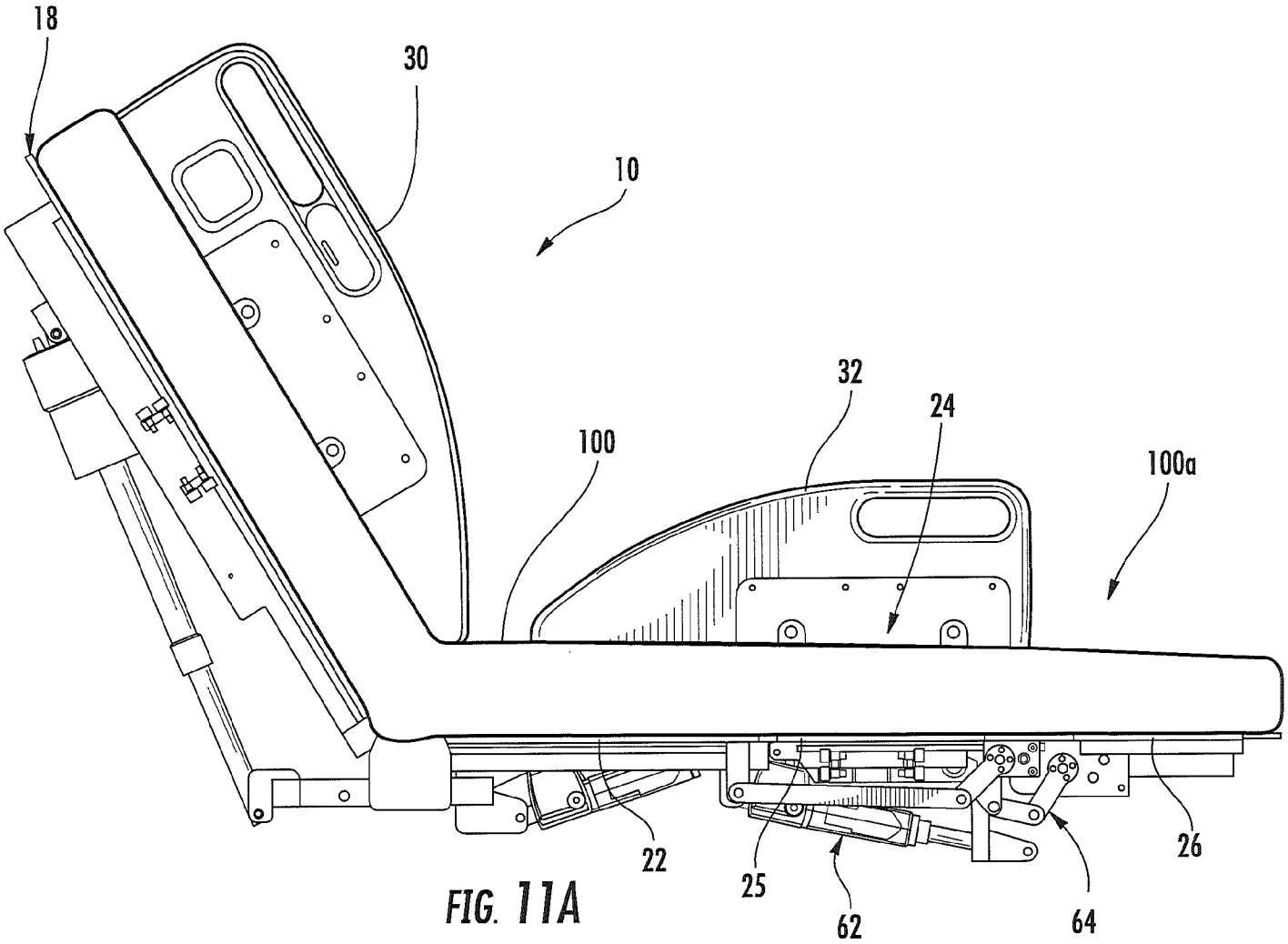
FIGS. 11A-11I are side views of the hospital chair bed of FIGS. 1 and 2 with a mattress assembly supported on the patient support surface and illustrating the transformation of the foot section of the mattress assembly as the bed is moved from a bed configuration to a chair configuration, according to some embodiments of the present invention.
Figure 11B:
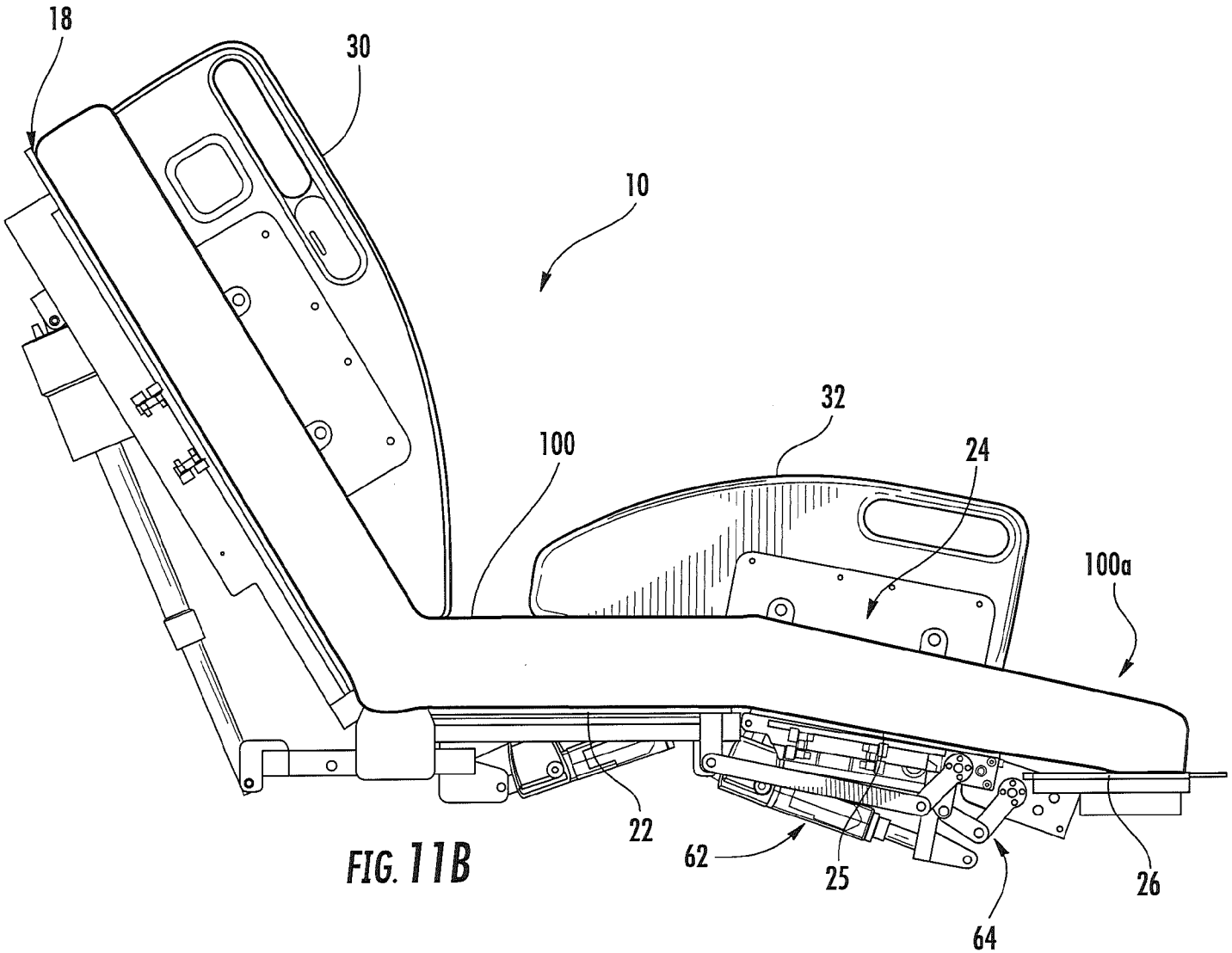
Figure 11C:
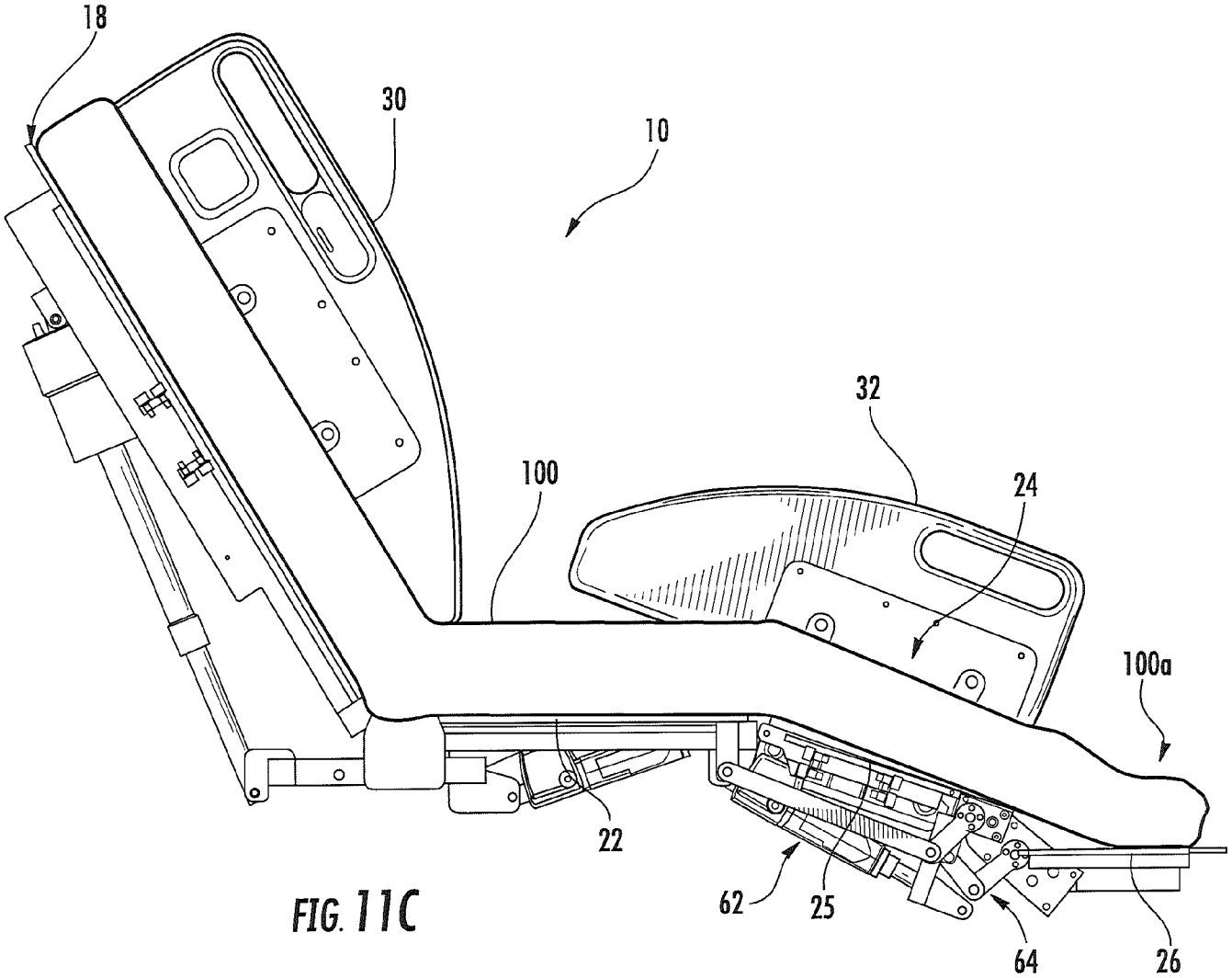
Figure 11D:
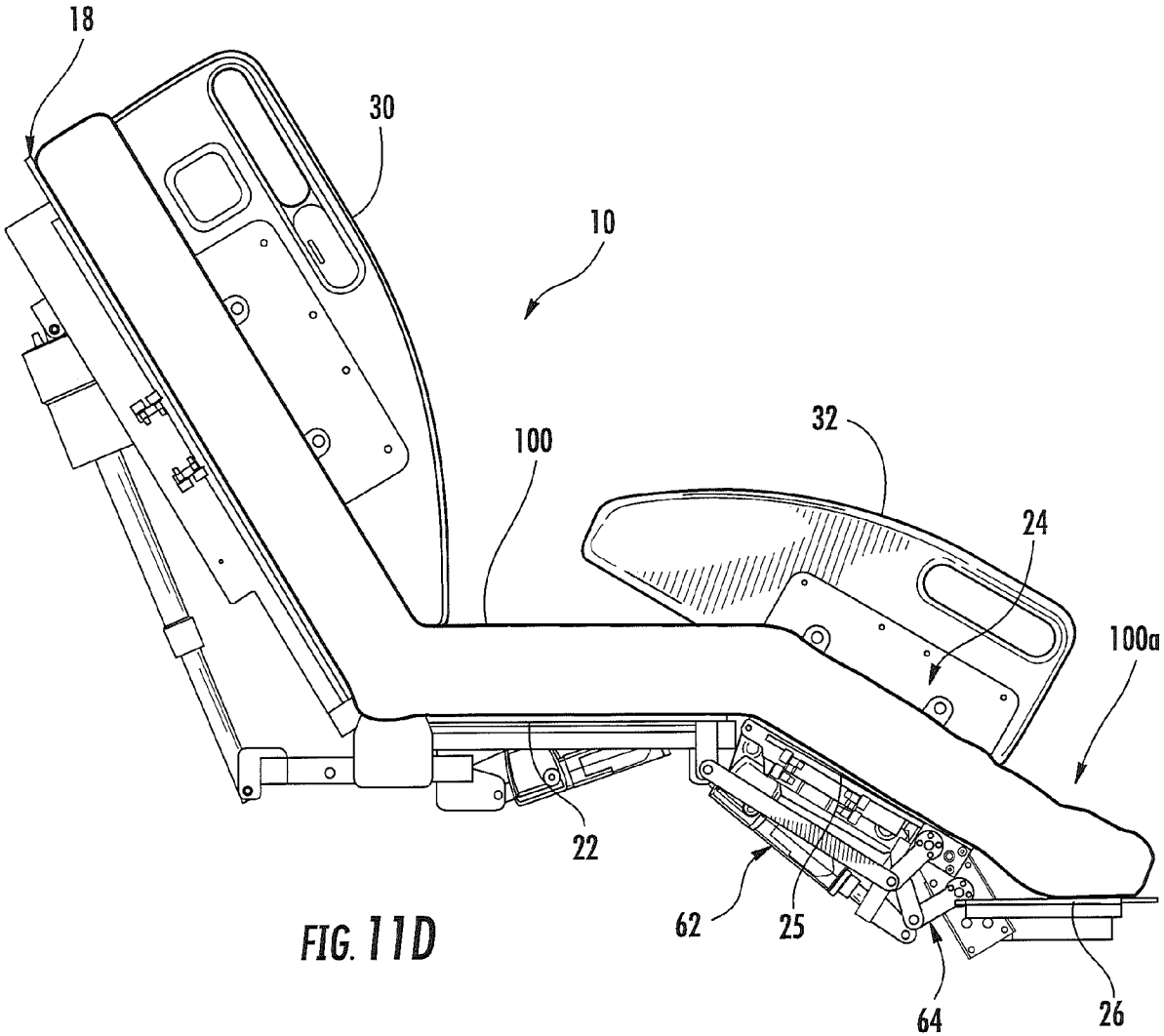
Figure 11E:
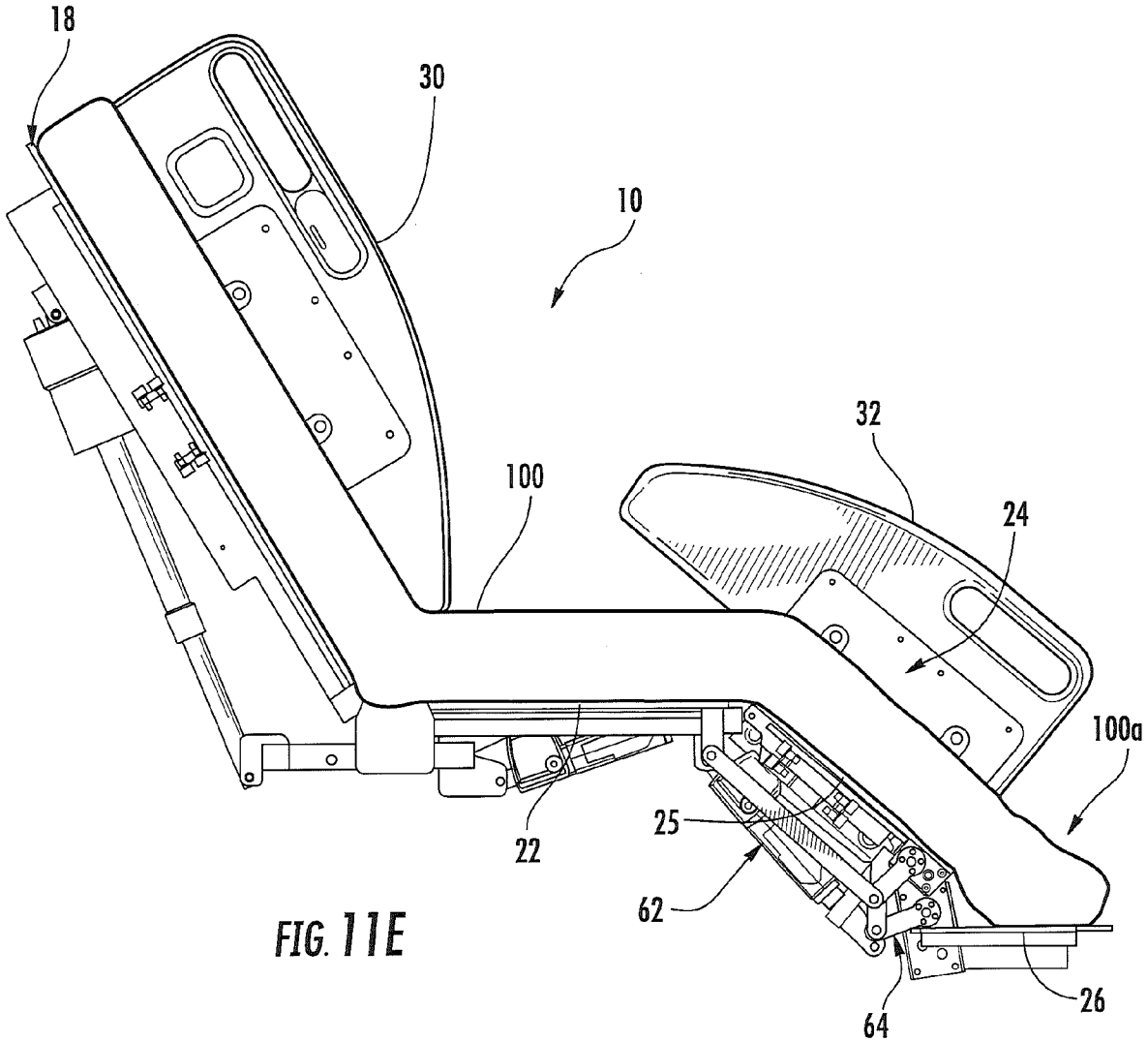
Figure 11F:
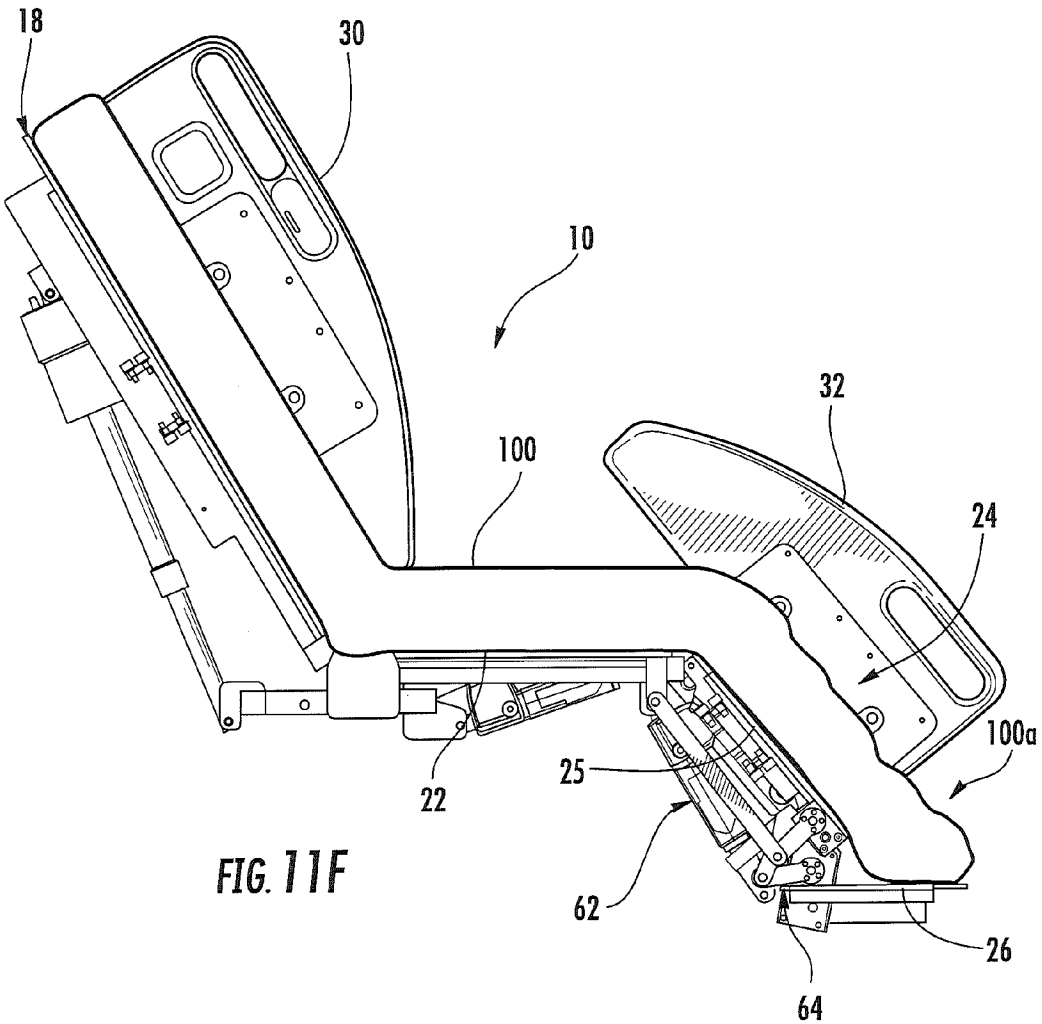
Figure 11G:
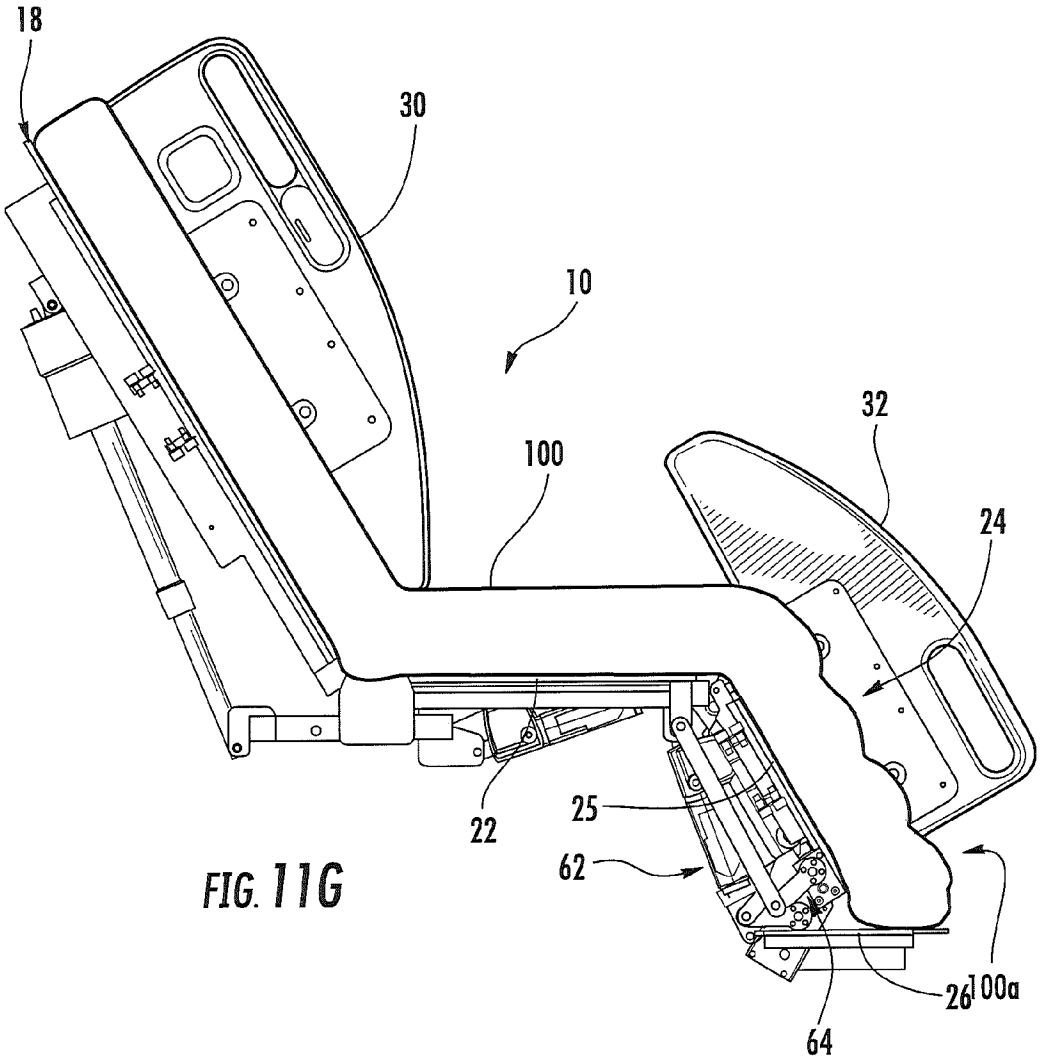
Figure 11H:
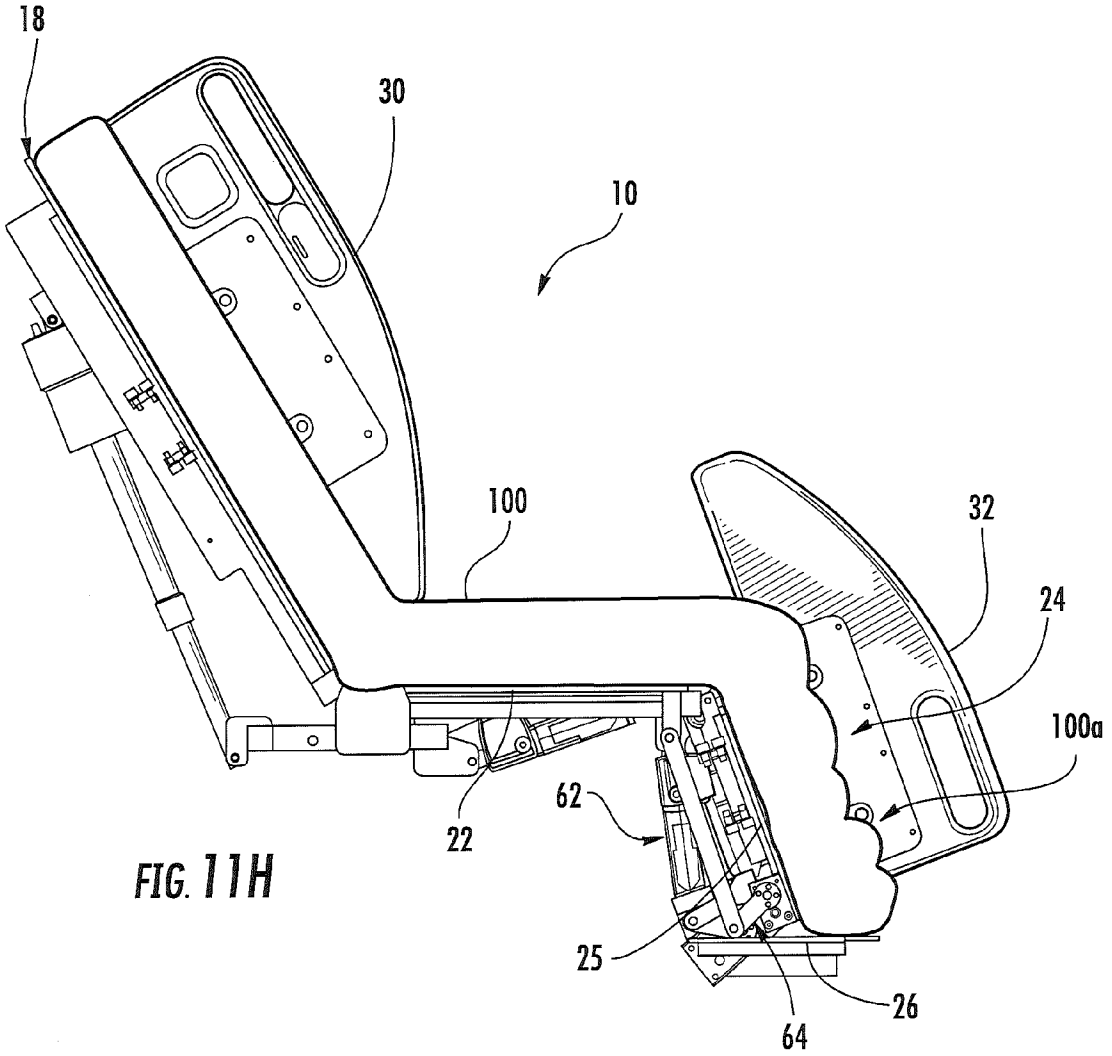
Figure 11I:
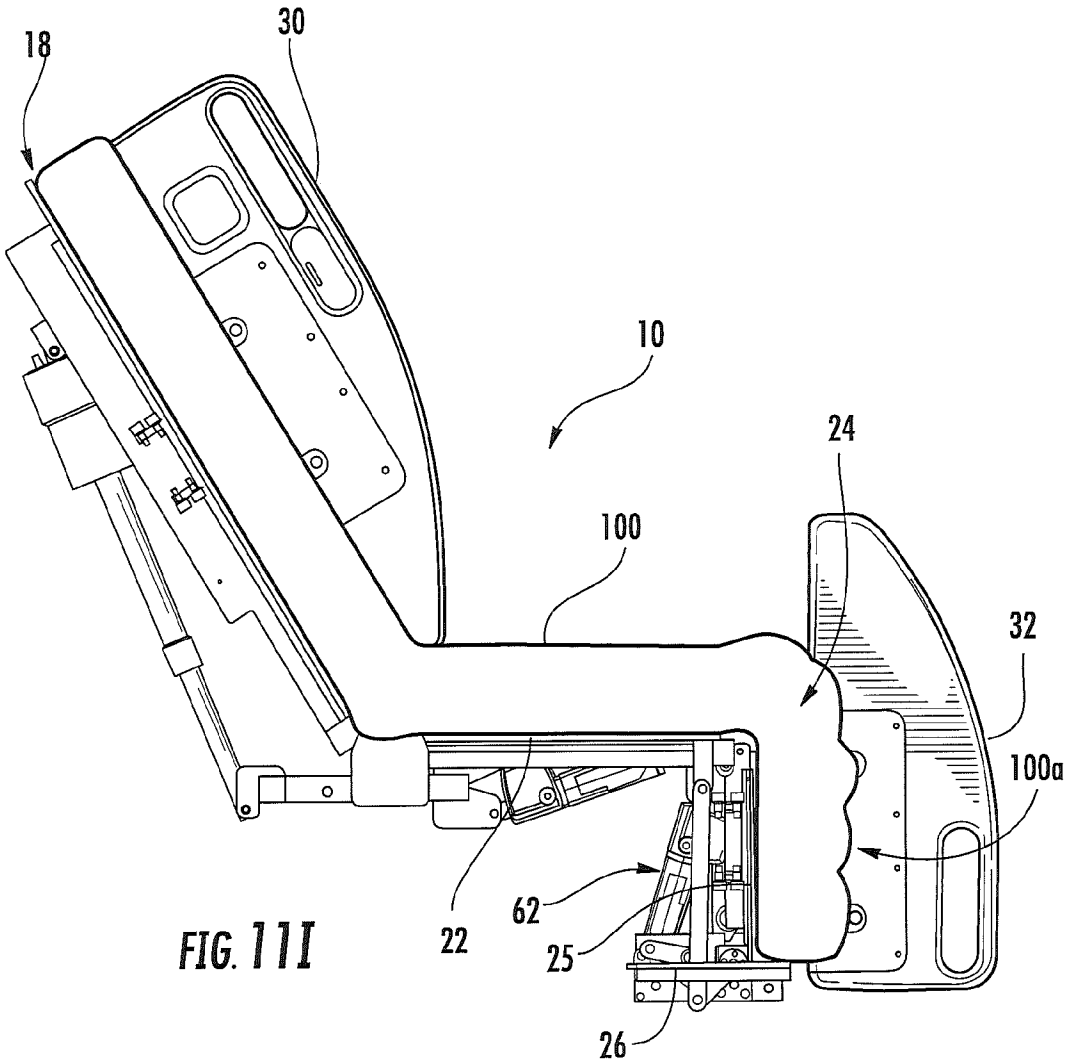
Figure 12:
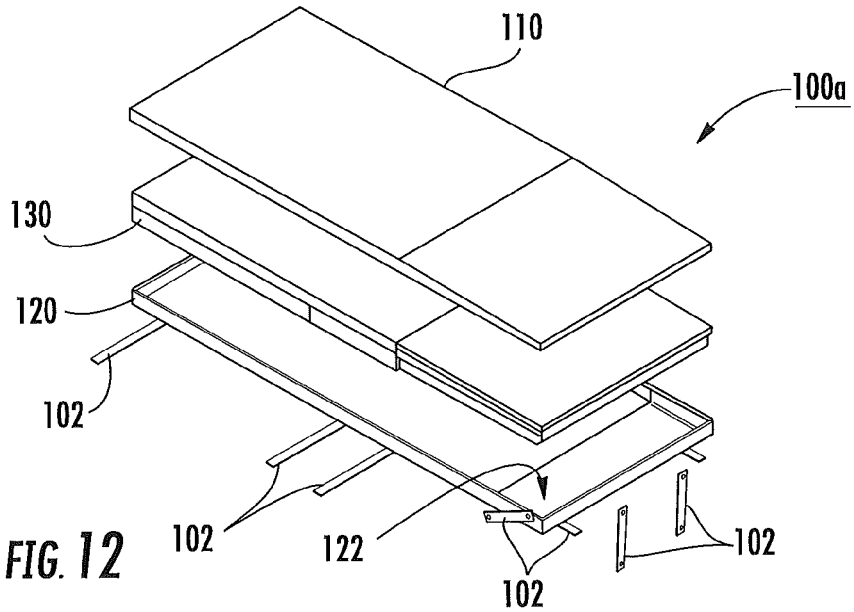
FIG. 12 is an exploded perspective view of an exemplary mattress assembly of FIGS. 11A-11I, according to some embodiments of the present invention.
Figure 13:
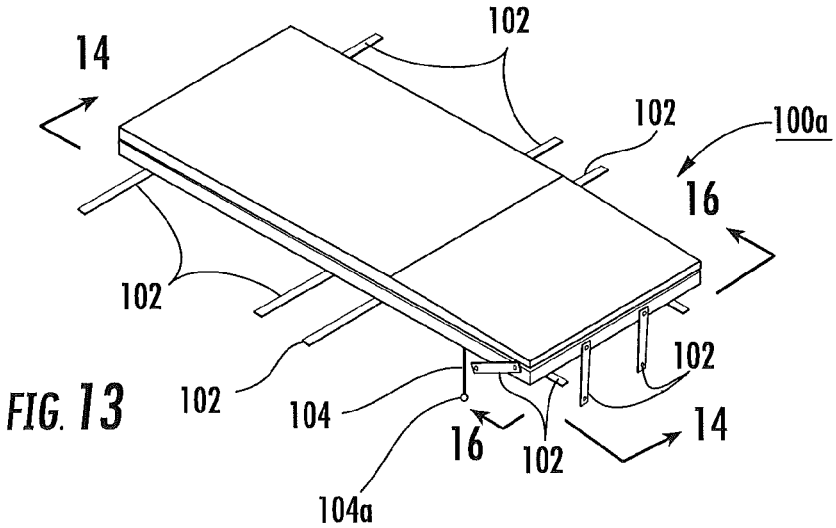
FIG. 13 is a perspective view of the mattress assembly of FIG. 12 in an assembled configuration.
Figure 14:
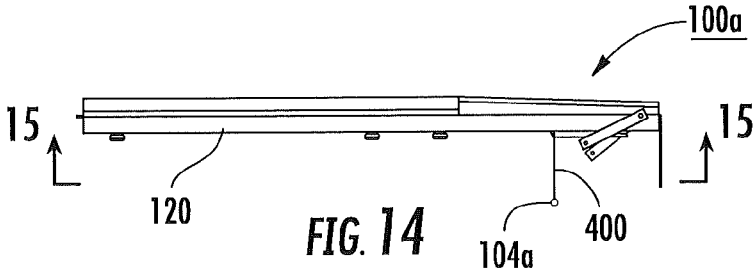
FIG. 14 is a side view of the mattress assembly of FIG. 13 taken along lines 14-14.
Figure 15:
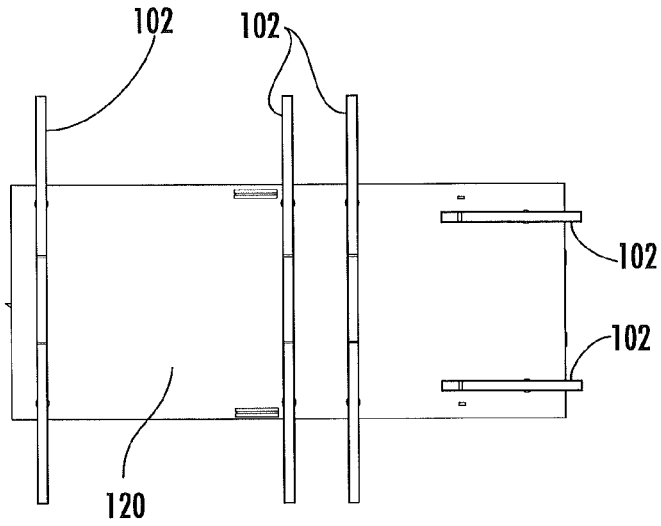
FIG. 15 is a bottom plan view of the mattress assembly of FIG. 14 taken along lines 15-15.
Figure 16:
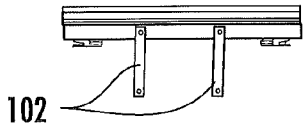
FIG. 16 is an end view of the mattress assembly of FIG. 13 taken along lines 16-16.

In operation, the bed 10 of the present invention typically has the back section 20, seat section 22, and foot section 24 in a horizontal configuration as shown in FIG. 1, to support a patient in a supine position. To convert the bed 10 to a chair configuration, the back section 20, seat section 22 and foot section 24 articulate relative to each other as shown in FIGS. 10A-10C, by a plurality of actuators (e.g., pneumatic or hydraulic cylinders or other suitable electrical devices or electromechanical devices). For example, in the illustrated embodiment, a first actuator 60 is utilized to pivot the back section 20 upwardly relative to the seat section 22. A second actuator 62, in conjunction with a plurality of linkages (referred to collectively as 64), is configured to pivot the foot section 24 relative to the seat section 22 and to cause the first and second panels 25, 26 of the foot section to articulate relative to each other. As illustrated in FIGS. 10A-10C, foot section panels 25, 26 move from being horizontal and in co-planar relationship in the bed position to being substantially orthogonal in the side egress chair position. As shown in FIG. 10C, the lower panel 26 can be substantially horizontal while the other panel 25 is substantially vertical. The lower panel 26 can extend toward the interior space of the bed/base frame 12 and a smaller portion of the lower panel 26 may reside forward of the upper panel 25 (adjacent a patient's leg or feet).

Figure 5:
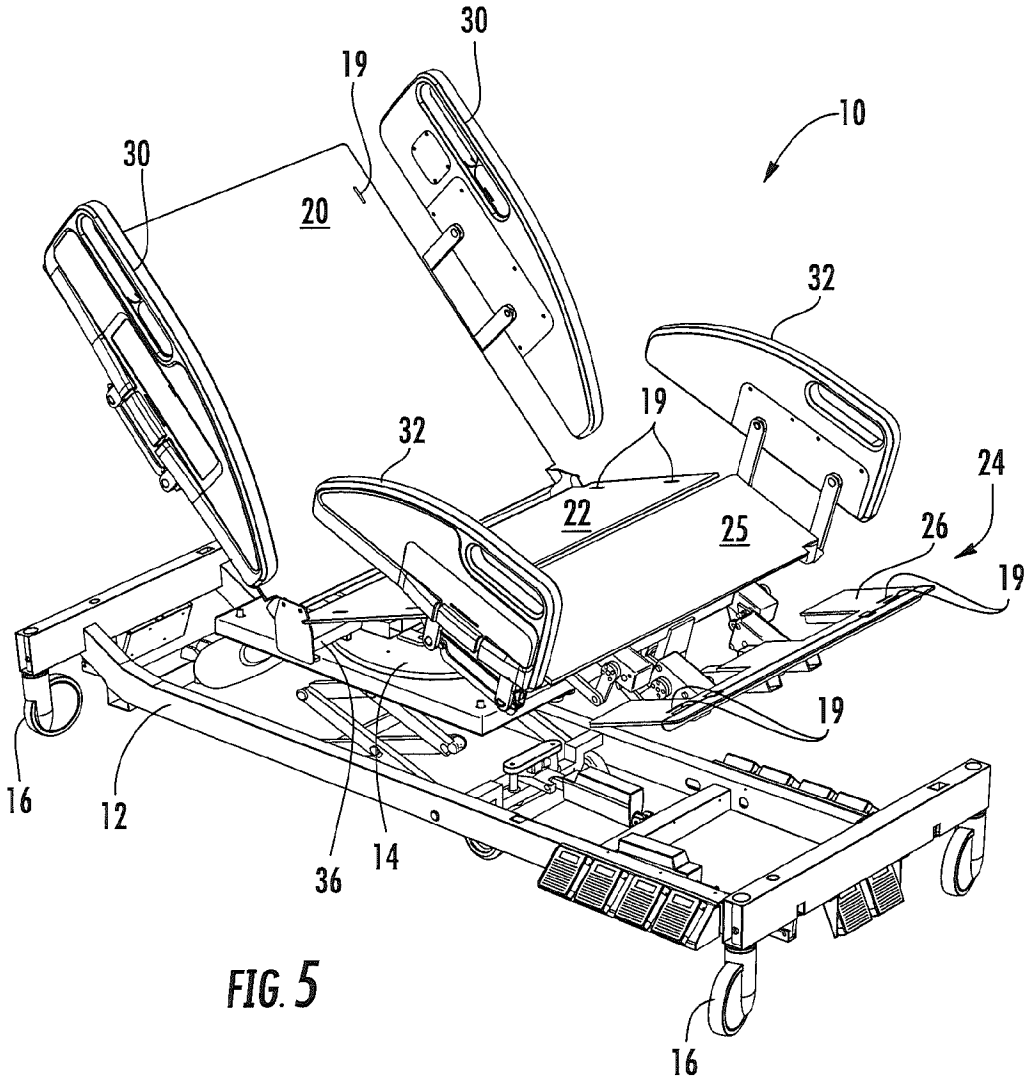
Figure 6:
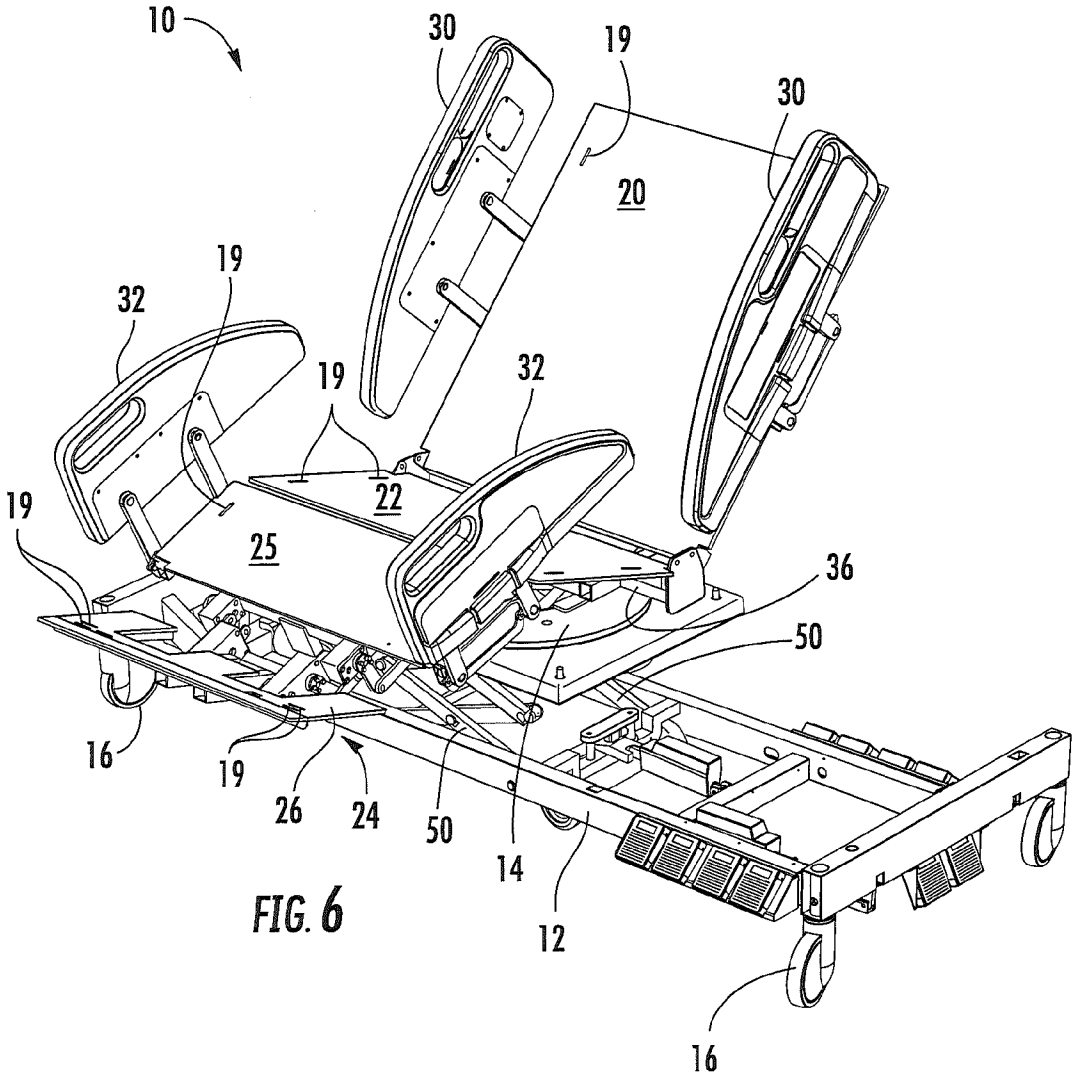

Referring to FIGS. 3-8, illustrate the transformation of the hospital chair bed 10 from the bed configuration to a chair configuration, according to some embodiments of the present invention. Initially, the hospital chair bed 10 is in a bed configuration, as illustrated in FIG. 3. The transformation to a chair configuration can be carried out so that, the back section 20 and seat section 22 can be pivoted relative to each other (FIG. 4) and the foot section 24 and seat section 22 are at least somewhat pivoted relative to each other (FIG. 5). In addition, the foot section panels 25, 26 may be articulated somewhat relative to each other as illustrated in FIG. 5. The articulated patient support surface 18 can be rotated approximately ninety degrees (90°) to permit side egress from the bed 10, as illustrated in FIG. 6. Once rotated approximately ninety degrees (90°) to permit side egress from the bed 10, the first and second panels 25, 26 of the foot section can continue to articulate relative to each other so as to be substantially perpendicular to each other, and the back section 20 and seat section 22 are articulated somewhat such that seat section 22 is substantially horizontal and back section 20 is substantially vertical, as illustrated in FIG. 7.

Figure 8:
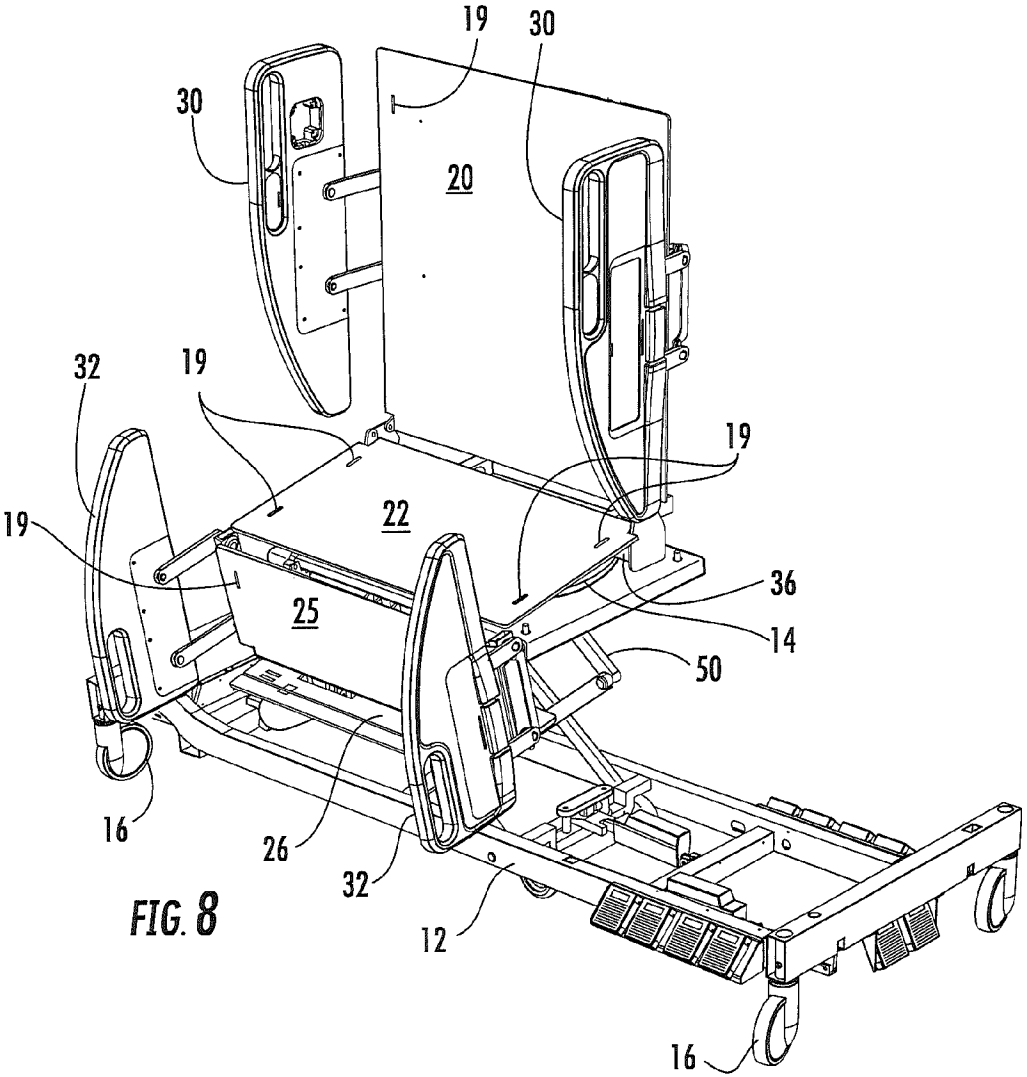

The side rails 32, which can be secured to the foot section 24, rotate with the foot section first panel 25 and are oriented such that a longitudinal direction thereof $A_1$ can be vertical or substantially vertical when the bed is in a side egress position (FIG. 7). The side rails 32 can be configured to be used as support handles to help a patient stand up from a sitting position on the support surface 18. The seat and back sections 22, 20 of the patient support surface 18 may then be raised and the seat section 22 tilted forward as a unit to facilitate patient egress from the bed 10 (e.g., a "stand-assist" orientation) by a patient, as illustrated in FIG. 8. In the illustrated stand-assist orientation, the seat section 22 may be downwardly angled relative to horizontal and the articulated foot section panels 25, 26 may be moved further toward the interior space of the bed/base frame 12. For example, the seat section 22 may be tilted downward at an angle of about 30 degrees or less relative to horizontal while the back section is substantially vertical. In some embodiments, the seat section 22 may be tilted downward at an angle of about 15 degrees or less relative to horizontal.

Figure 9:
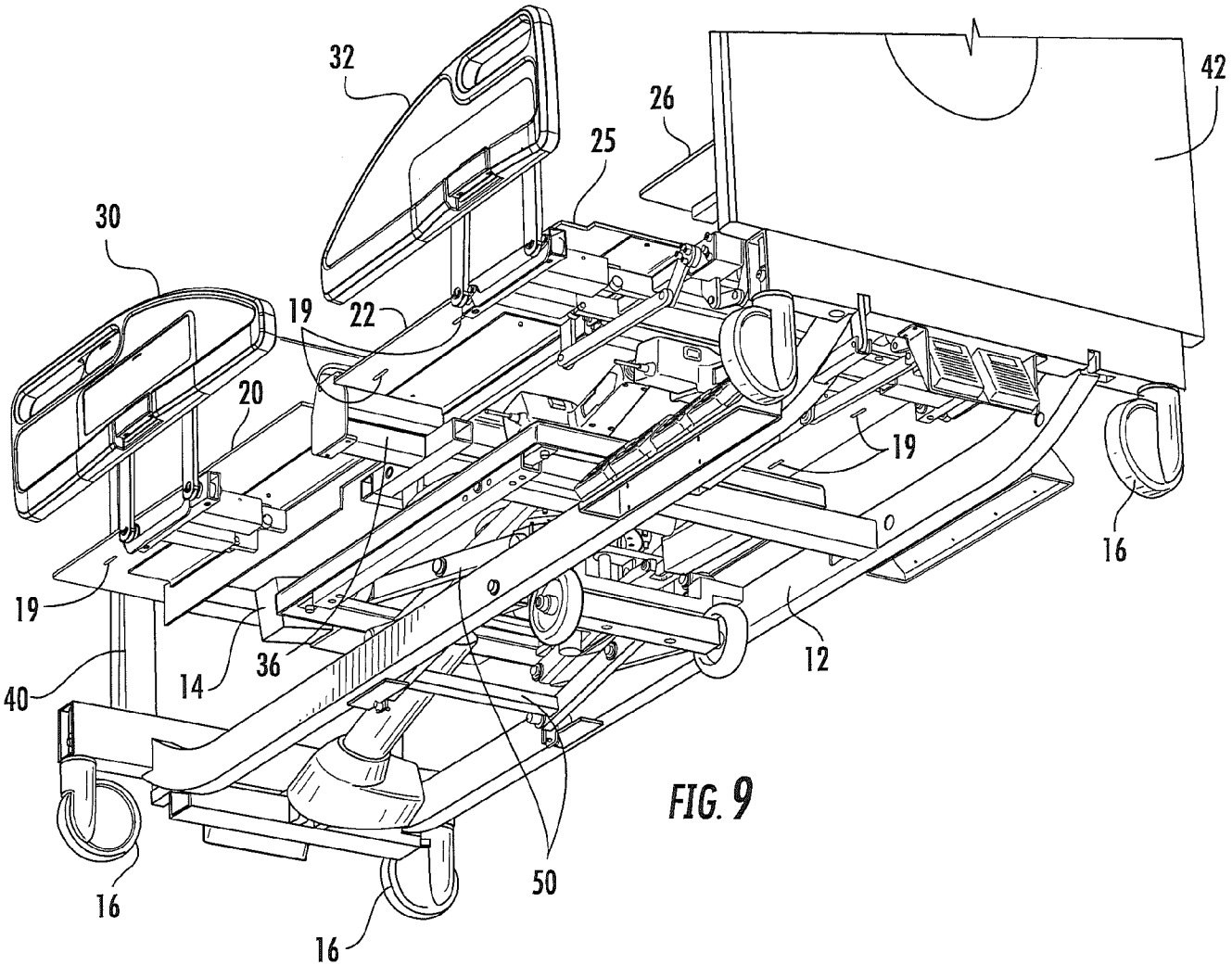
FIG. 9 is a bottom perspective view of the hospital chair bed of FIGS. 1 and 2.

FIG. 9 is a bottom perspective view of the bed 10 illustrating various linkages and actuators associated with the articulating patient support surface 18, as well as the rotating frame 14 and lift mechanism 50.

FIGS. 11A-11I are side elevation views of the hospital chair bed 10 with a mattress assembly 100 supported by the articulating patient support surface 18. As the patient support surface 18 is articulated from a bed configuration to a chair configuration, the foot portion 100*a* of the mattress assembly 100 is retractable such that it maintains contact with, and does not extend beyond, the foot section panel 26. The mattress assembly 100 is described in detail below with reference to FIGS. 12-21.

Referring to FIGS. 12-16, the mattress assembly 100 is illustrated according to some embodiments of the present invention. The illustrated mattress assembly 100 includes a cover assembly 110, a base assembly 120, and a foam assembly 130 sandwiched between the cover assembly 110 and base assembly 120. The cover assembly 110, base assembly 120, and foam assembly 130 can be adhesively secured together and are surrounded by a ticking material (not shown). As known to those skilled in the art of mattresses, ticking is typically a high quality knit or woven textile and may be decorative in appearance. The ticking is typically externally attached to foot section panel 26 via straps (e.g., nylon webbing) and metal snaps so that when the foot section panel 26 is oriented 90 degrees upward (FIG. 111) it allows for the end of the mattress assembly 100 to pull up and to rest on the folded foot section panel 26.

In the illustrated embodiment, the mattress assembly 100 is attached to the patient support surface 18 via a plurality of straps 102 (e.g., nylon webbing straps, etc.). The straps 102 are attached to the mattress ticking, extend down through various respective slots 19 formed in the patient support surface 18, and are fastened via connectors under the patient support surface 18. Exemplary connectors are "D" rings. However, various types of connectors and various ways of securing the mattress assembly 100 to the patient support surface 18 can be utilized, without limitation.

Figure 17:
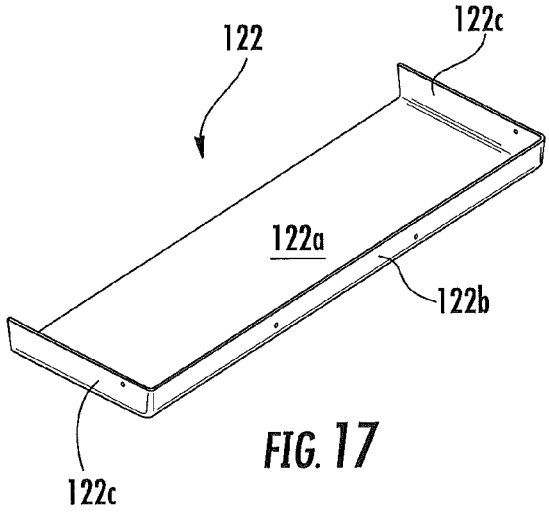
FIG. 17 is an enlarged perspective view of an exemplary foot section insert utilized in the mattress assembly of FIG. 12, according to some embodiments of the present invention.
Figure 18:
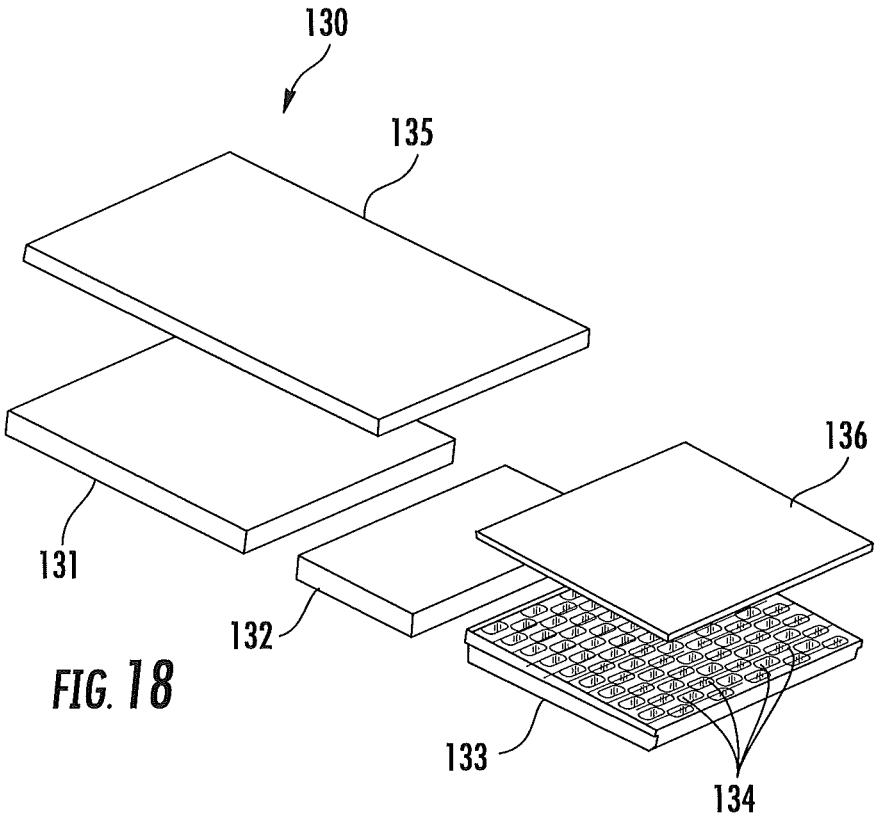
FIG. 18 is an exploded perspective view of an exemplary foam assembly of the mattress assembly of FIGS. 11A-11I, according to some embodiments of the present invention.
Figure 19:
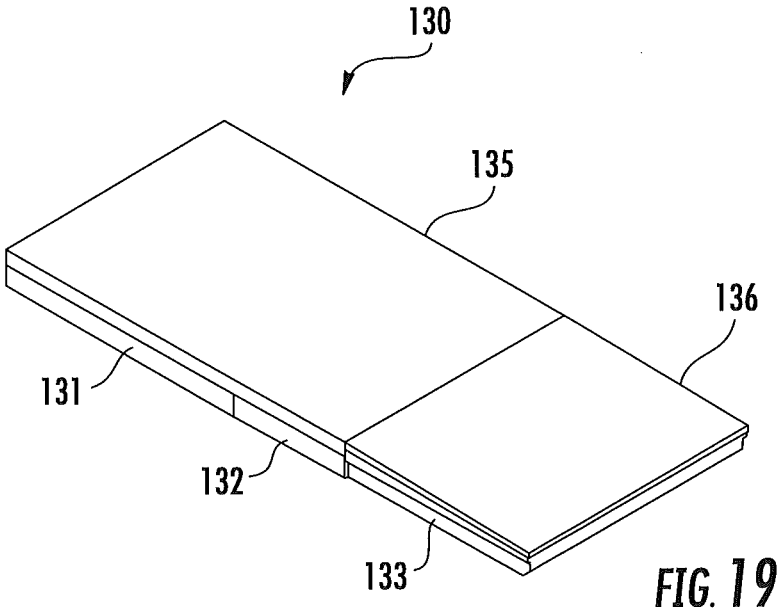
FIG. 19 is a perspective view of the foam assembly of FIG. 18 in an assembled configuration.
Figure 20:
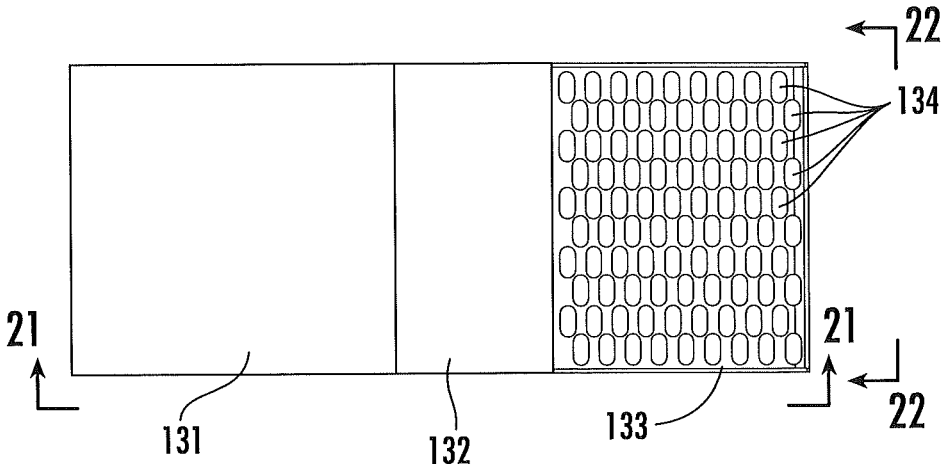
FIG. 20 is a top plan view of the foam assembly of FIG. 19 with the memory foam section removed.
Figure 21:
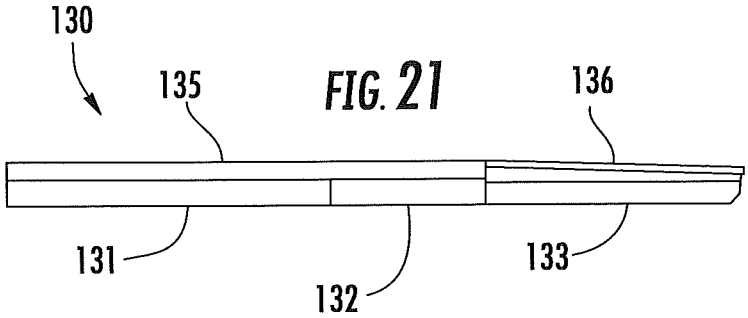
FIG. 21 is a side view of the foam assembly of FIG. 20 taken along lines 21-21 and with the memory foam section installed.
Figure 22:
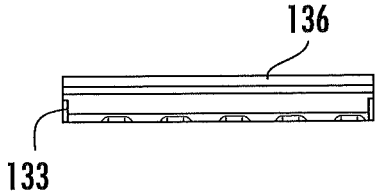
FIG. 22 is an end view of the foam assembly of FIG. 20 taken along lines 22-22 and with the memory foam section installed.

The base assembly 120 includes a foot section insert 122. The foot section insert 122 is substantially rigid and contacts the foot end portion of the foam assembly 130 and cover assembly 110 when the mattress assembly 100 is assembled. As shown in FIG. 17, according to some embodiments of the present invention, the foot section insert 122 has a bottom panel 122*a* with a raised end wall 122*b* and opposite raised side walls 122*c*. The foot section insert 122 facilitates retraction of the foot portion 100*a* of the mattress assembly 100 and provides rigidity to the foot portion 100*a* of the mattress assembly 100.

The foot portion 100*a* of the mattress assembly 100 includes a pair of retaining members 104 that are attached to the ticking and that are configured to be attached to the patient support surface 18 of the hospital chair bed 10. The retaining members 104 are configured to maintain the foot portion 100*a* of the mattress assembly 100 in contact with the foot section 24 as the hospital chair bed 10 is articulated from a bed configuration to a chair configuration. In some embodiments, retaining members 104 are cords (e.g., elastic cords, etc.) having an eyelet at a free end 100*a* thereof. In this embodiment, a fastener (e.g., a bolt, screw, rivet, pin, etc.) is inserted through the eyelet and is secured to the patient support surface 18.

Referring now to FIGS. 18-22, the foam assembly 130 includes head, seat and foot sections 131, 132, 133 that are secured together (e.g., adhesively secured together, etc.) in substantially co-planar configuration. The head, seat and foot sections 131, 132, 133 may be formed from any type of foam including, but not limited to, urethane foam. The foot section 133 has a tapered configuration and can include a plurality of cut-outs or apertures 134 formed therein in an array, as illustrated. These apertures 134 permit the foot section 133 to collapse such that the foot section 100*a* of the mattress assembly 100 can retract when the hospital chair bed 10 is moved from a bed configuration to a chair configuration.

The illustrated foam assembly 130 also includes first and second upper foam sections 135, 136. In some embodiments, the first and second upper foam sections 135, 136 are formed from a memory foam. Memory foam, as would be understood by those skilled in the art, is configured to mould itself to the shape of a portion of the body of a patient in contact therewith. The first and second upper foam sections 135, 136 are adhesively secured to the underlying head, seat and foot sections 131, 132, 133 and may be adhesively secured to each other. Upper foam sections 135, 136 do not include apertures in the illustrated embodiment.

Referring to FIGS. 23-34, a hospital bed 10, according to other embodiments of the present invention, is illustrated. The illustrated bed 10 has a base 12 and a rotating frame 14 mounted on the base 12. The frame 14 is configured to rotate relative to the base 12 to facilitate side egress from the bed 10 by a patient, as will be described below. Casters 16 are mounted to the four corners of the base 12 and facilitate movement of the bed about the hospital. In some embodiments, casters 16 are locking casters that can be selectively locked to prevent movement of the bed 10.

The illustrated bed 10 has a patient support surface 18 configured to support a mattress (not illustrated) on which a patient is situated. The patient support surface 18 is supported by the rotating frame 14 and includes a back section 20, a seat section 22, and a foot section 24. The back section 20, seat section 22 and foot section 24 can articulate with respect to each other and can be serially hinged together, as illustrated. The back section 20 and seat section 22 can be pivotally attached to each other by pins, hinges, or other suitable mechanisms well known in the art. The seat section 22 and foot section 24 can also be pivotally attached to each other by pins, hinges, or other suitable mechanisms well known in the art.

The bed 10 also has a first set of patient side rails 30 typically secured to the back section 20 in spaced-apart relationship and a second set of patient side rails 32 typically secured to the seat section 22 or foot section 24 in spaced-apart relationship, as illustrated. A head board is 40 can be secured to the base 12 at the head end of the bed 10 and a foot board 42 can be secured to the base 12 at the foot end of the bed 10, as illustrated.

The patient support surface 18 can be secured to the rotating frame 14 via a transverse rod or pin connection (not illustrated) to facilitate tilting of the patient support surface 18 relative to the rotating frame 14. The rotating frame 14 is secured to the base 12 via a lift mechanism 50, such as a scissors lift. The lift mechanism 50 is configured to raise and lower the patient support surface, via the rotating frame 14, relative to the base 12. The lift mechanism 50 can be driven by hydraulics cylinders, air cylinders, air bags, and/or electrical devices, etc. The lift mechanism 50 can be configured to allow the patient support surface 18 to be raised relatively high relative to the base 12 and to be lowered relatively low with respect to the base 12. See, e.g., co-pending U.S. patent application Ser. No. 11/398,098 for examples of rotational and lift components, which is incorporated herein by reference in its entirety.

Figure 23:
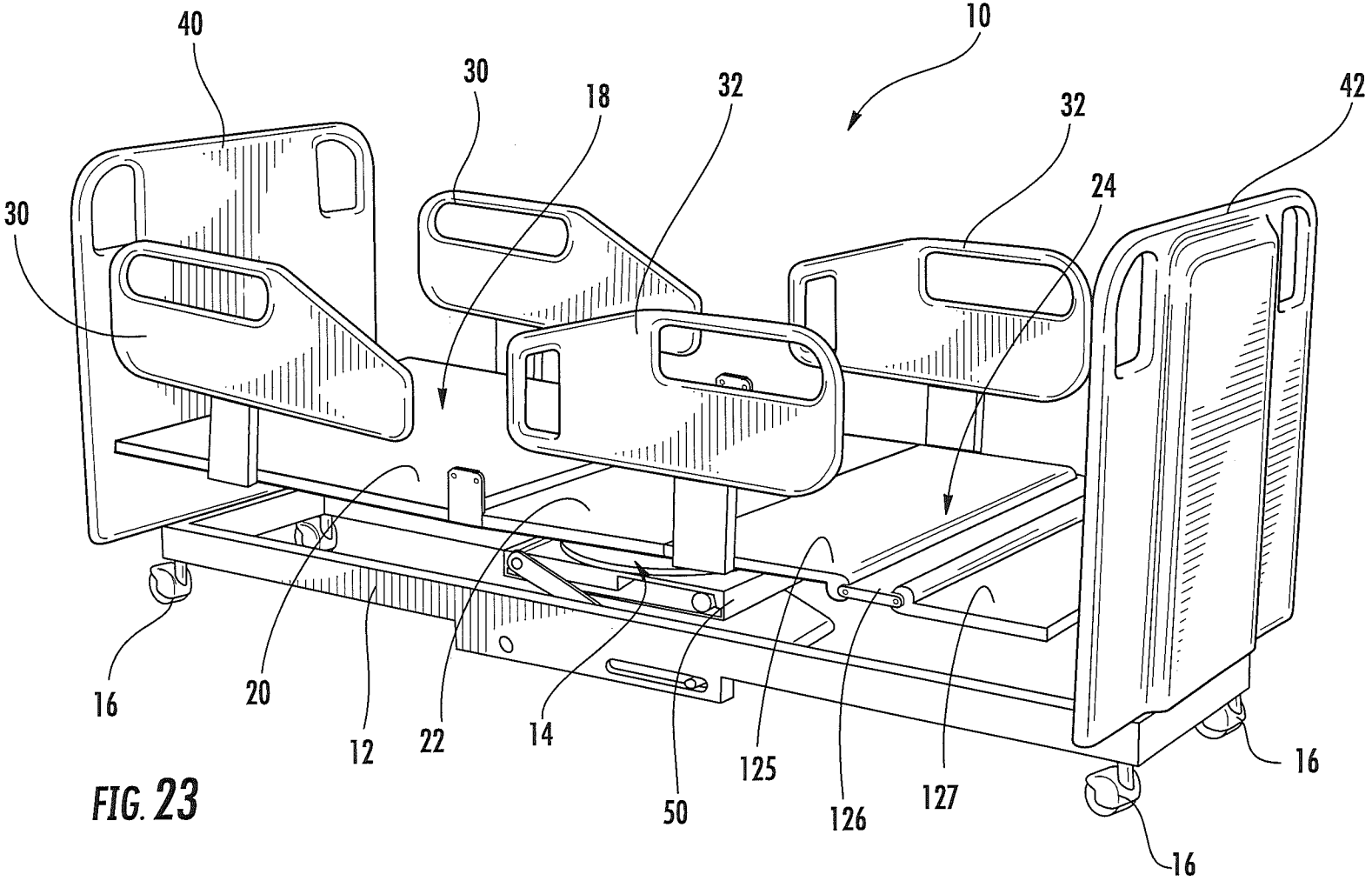
FIG. 23 is a top perspective view of a hospital chair bed in the bed configuration, according to another embodiment of the present invention.
Figure 30:
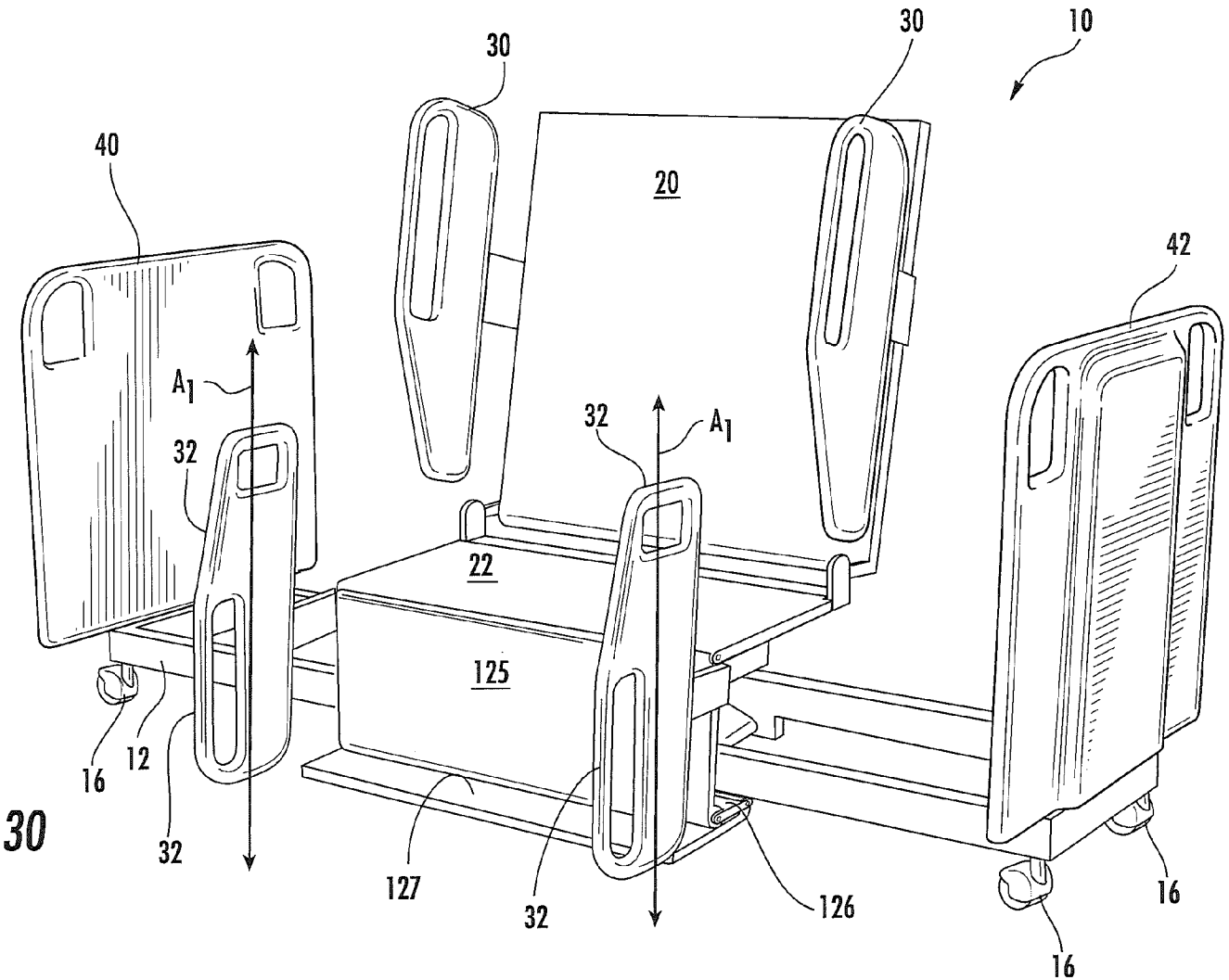

The foot section 24 includes a first panel 125, a second panel 126, and a third panel 127 pivotally connected together in series, as illustrated. The foot section first panel 125 is pivotally connected to the seat section 22 of the articulating patient support surface 18. When the patient support surface 18 is in a horizontal configuration to support a patient in a supine position, the foot section first, second and third panels 125, 126, 127 can be in substantially co-planar relationship as illustrated in FIG. 23. The foot section panels 125, 126, 127 are configured to be able to fold together and/or overlap at least portions of each other when the patient support surface is in a chair configuration, as illustrated in FIG. 30.

Figure 31:
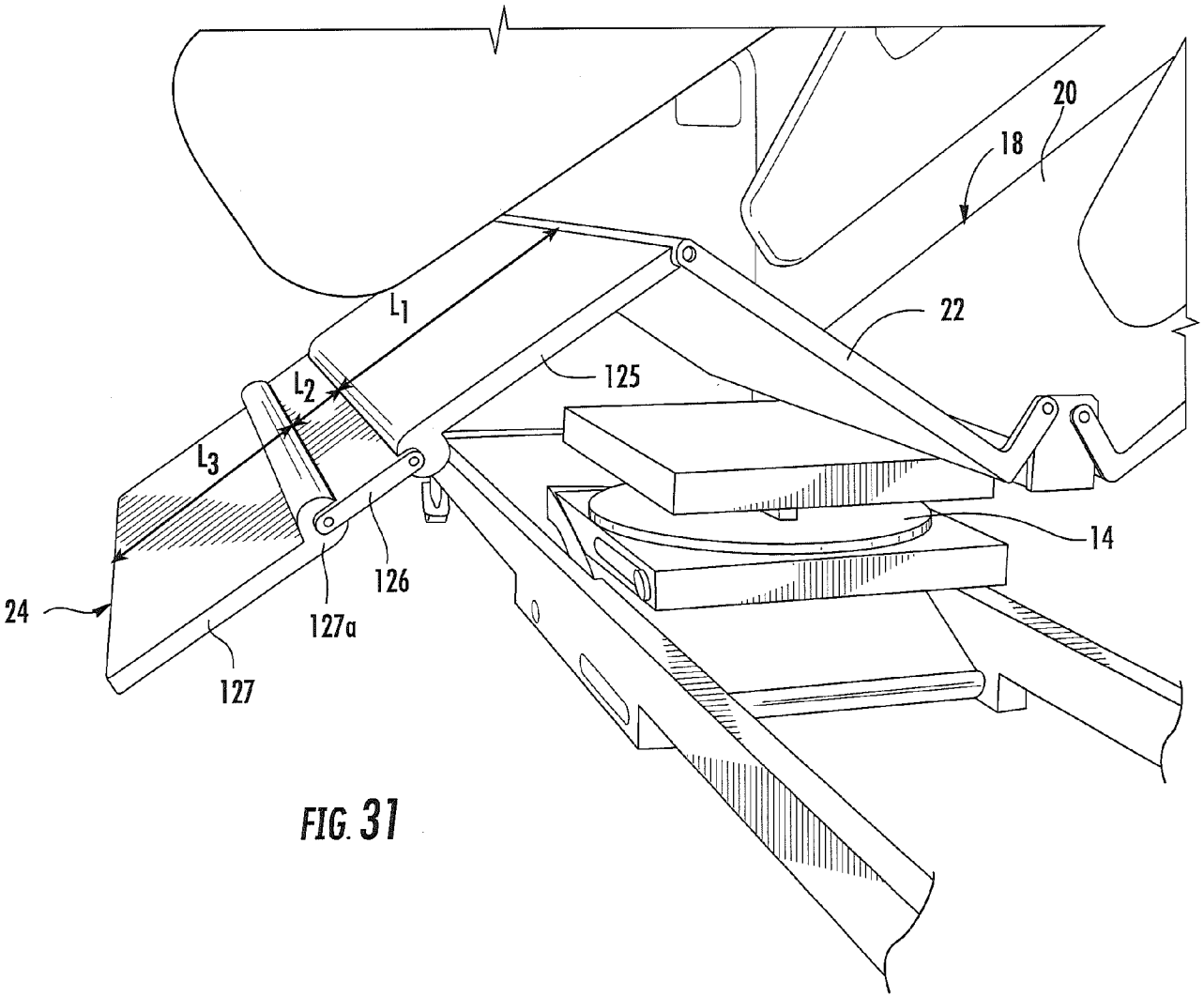
FIGS. 31-34 are enlarged, partial perspective views of the hospital chair bed of FIG. 23 illustrating the articulation of the foot section panels from a bed configuration to a chair configuration, according to some embodiments of the present invention.
Figure 32:
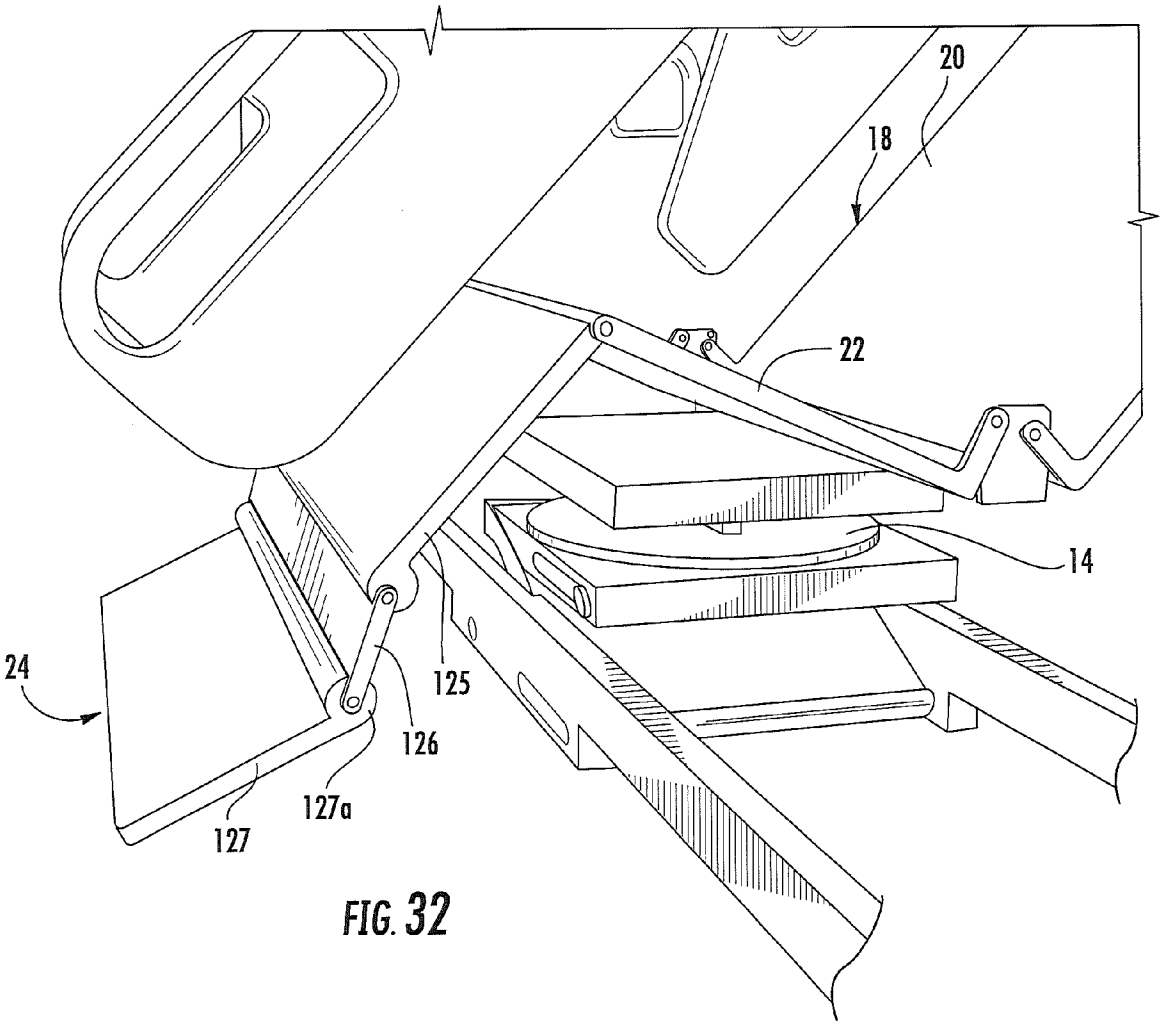
Figure 33:
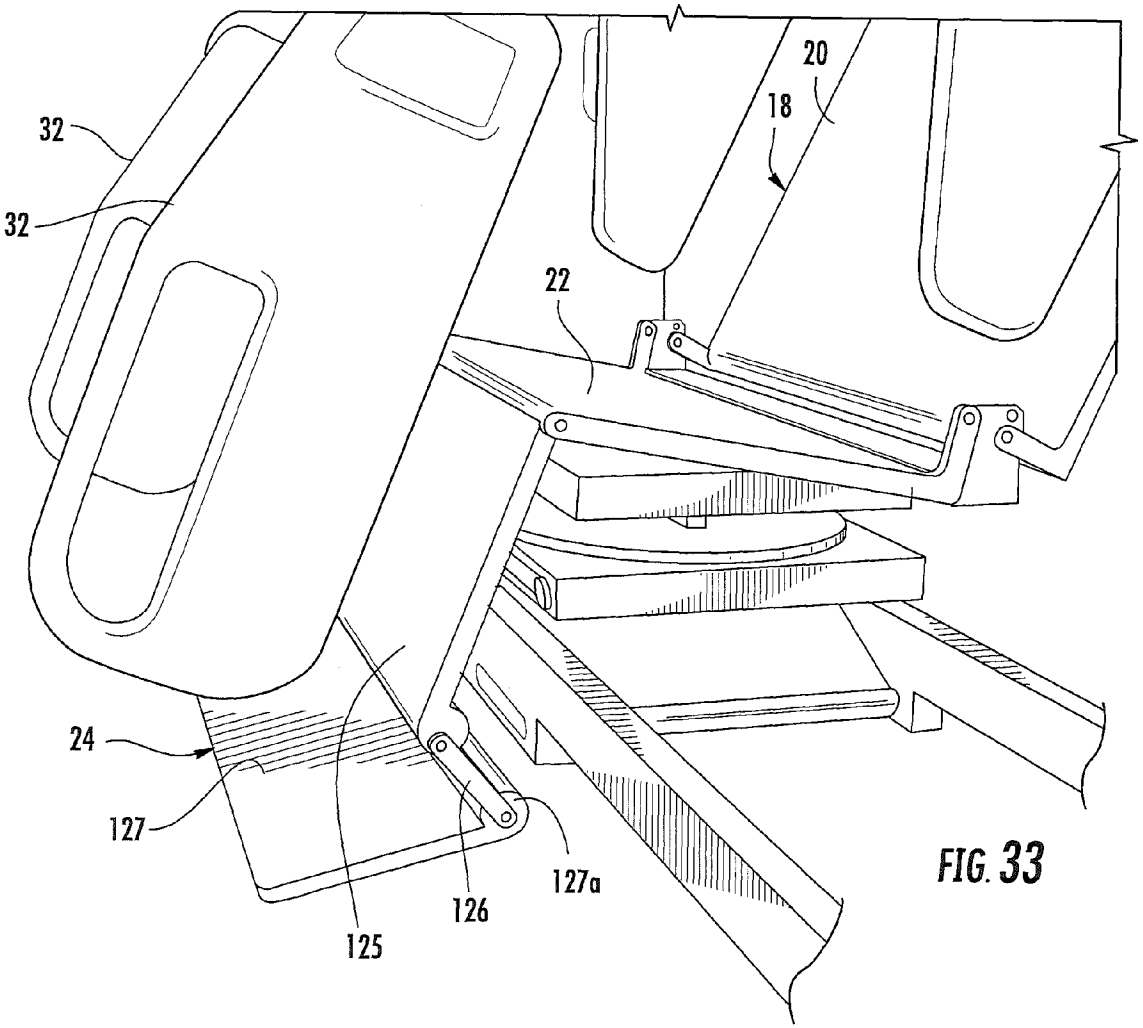

As illustrated in FIG. 31, the foot section panels 125, 126, 127 have respective different lengths $L_1$, $L_2$, $L_3$. The length $L_1$ of panel 125 is greater than the lengths $L_2$ and $L_3$ of panels 126 and 127. $L_1$ may be between about twelve inches and about twenty four inches (12"-24"). The length $L_3$ of panel 127 is greater than the length $L_2$ of panel 126, but is less than the length $L_1$ of panel 125. $L_3$ may be between about ten inches and about twenty inches (10"-20"). The length $L_2$ of panel 126 is less than both $L_1$ of panel 125 and $L_3$ of panel 127. $L_2$ may be between about six inches and about twelve inches (6"-12").

Figure 24:
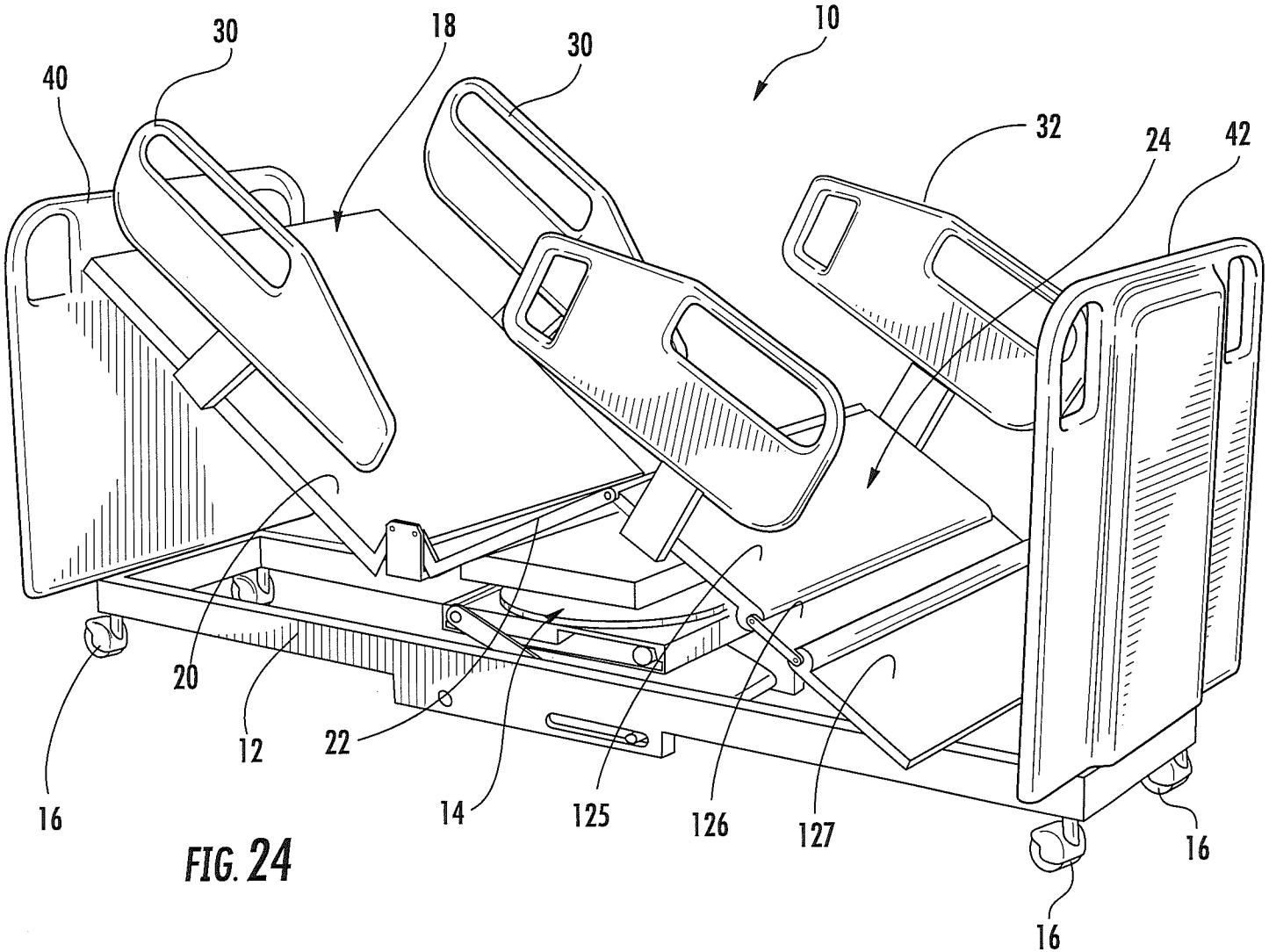
FIGS. 24-30 are perspective views of the hospital chair bed of FIG. 23, that illustrate the transformation of the hospital chair bed from the bed configuration to a chair configuration, according to some embodiments of the present invention.

In operation, the bed 10 of the present invention typically has the back section 20, seat section 22, and foot section 24 in a horizontal configuration as shown in FIG. 23, to support a patient in a supine position. To convert the bed 10 to a chair configuration, the back section 20, seat section 22 and foot section 24 articulate relative to each other as shown in FIG. 24, for example by an actuator (e.g., pneumatic or hydraulic cylinders or other suitable electrical devices or electromechanical devices). Specifically, as shown in FIG. 24, and similar to the embodiment shown in FIGS. 5 and 6, the back section 20 and seat section 22 can pivot relative to each other to form an upwardly facing V-shape while the foot section 24 and seat section 22 pivot relative to each other in a downwardly facing V-shape. The back section 20 and the seat section 22 can pivot relative to each other until they are substantially orthogonal to each other.

Figure 25:
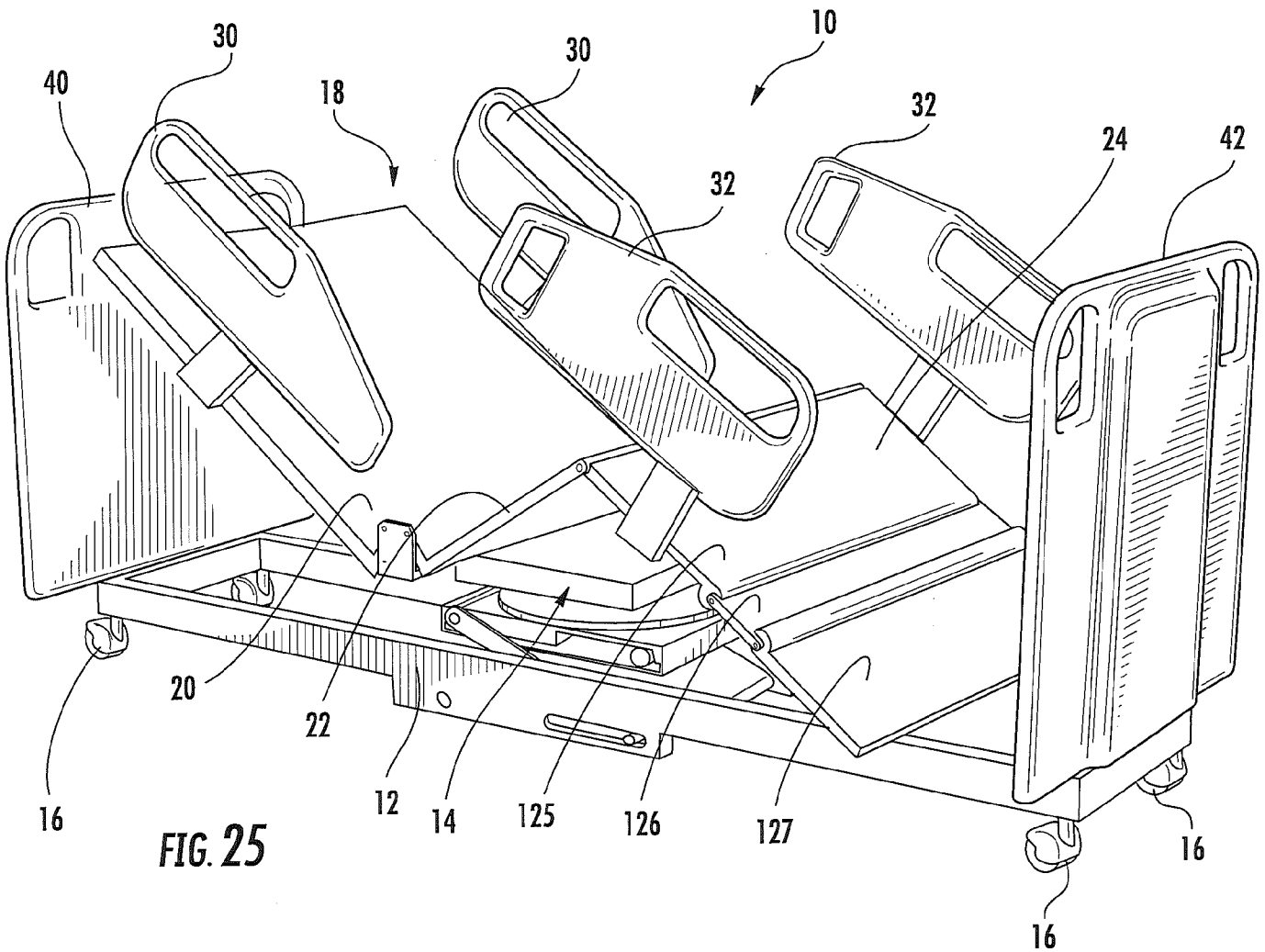
Figure 26:
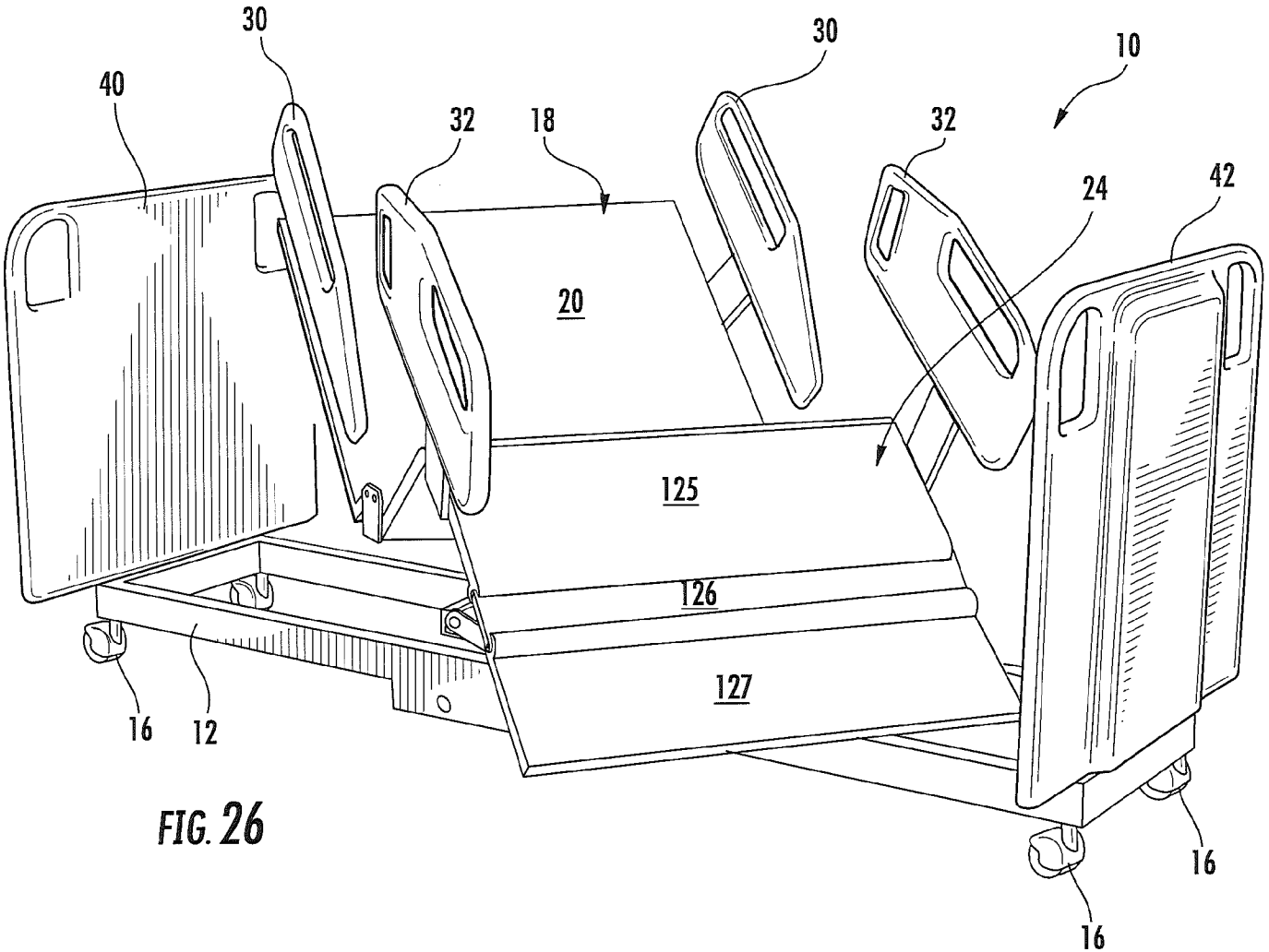
Figure 27:
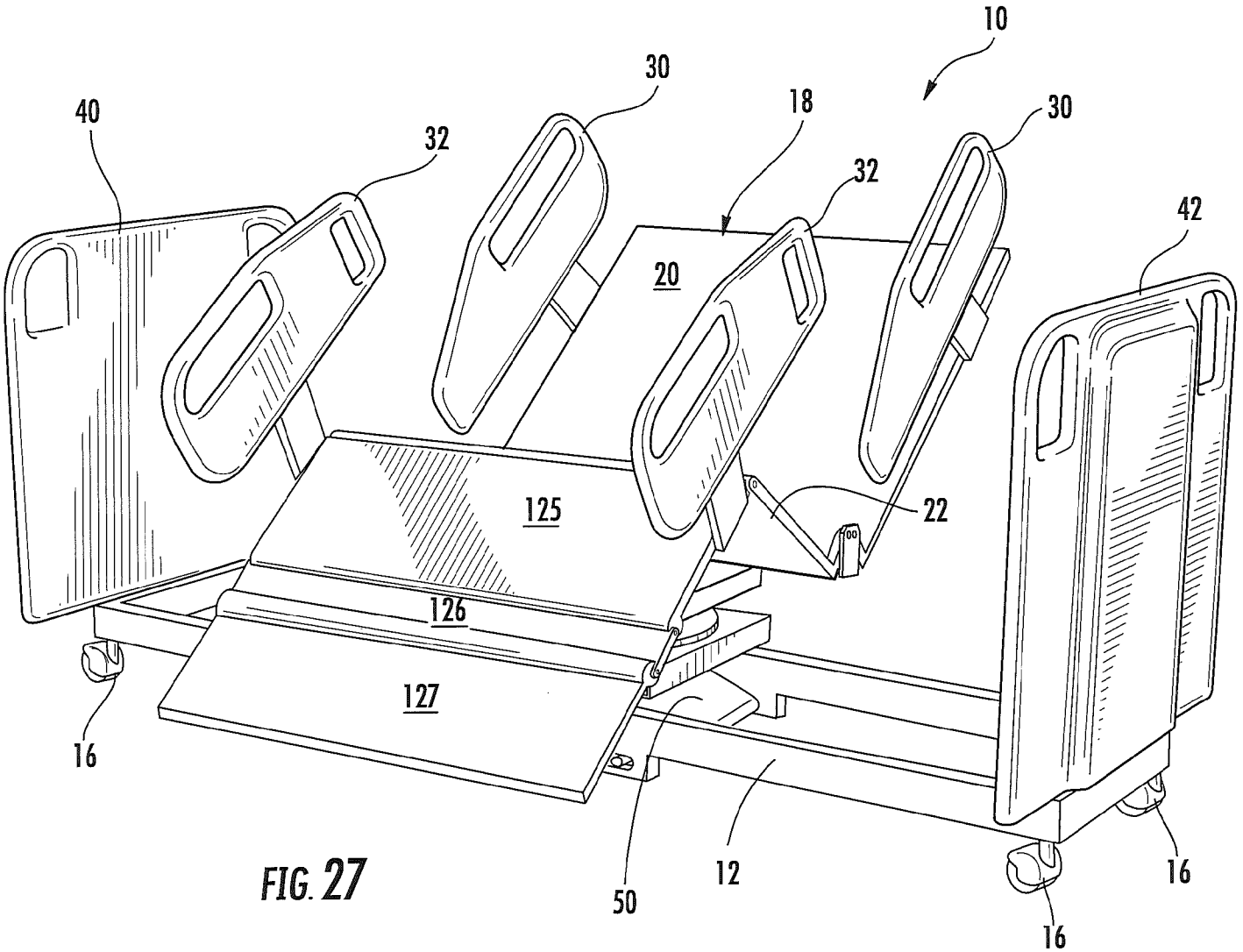
Figure 28:
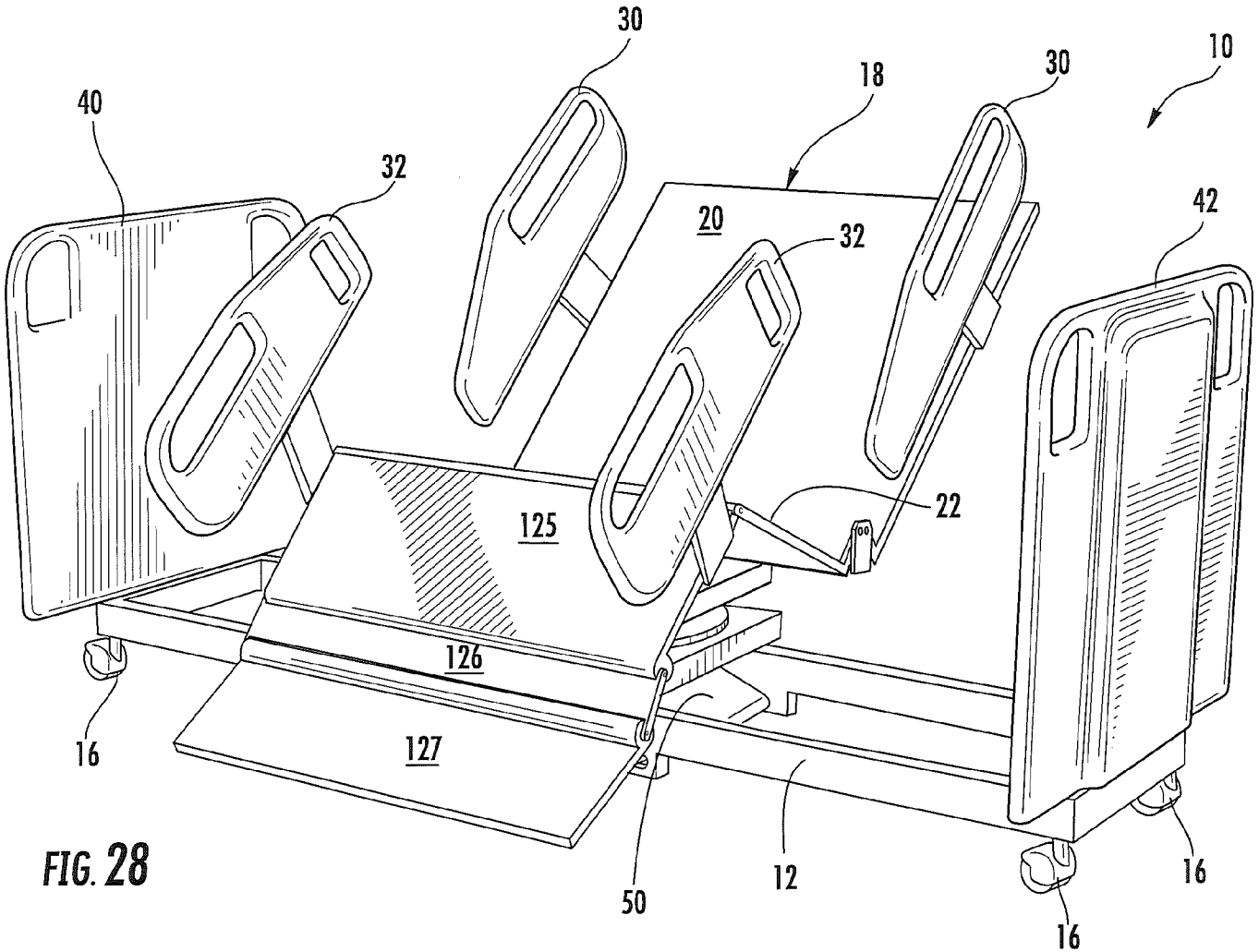
Figure 29:
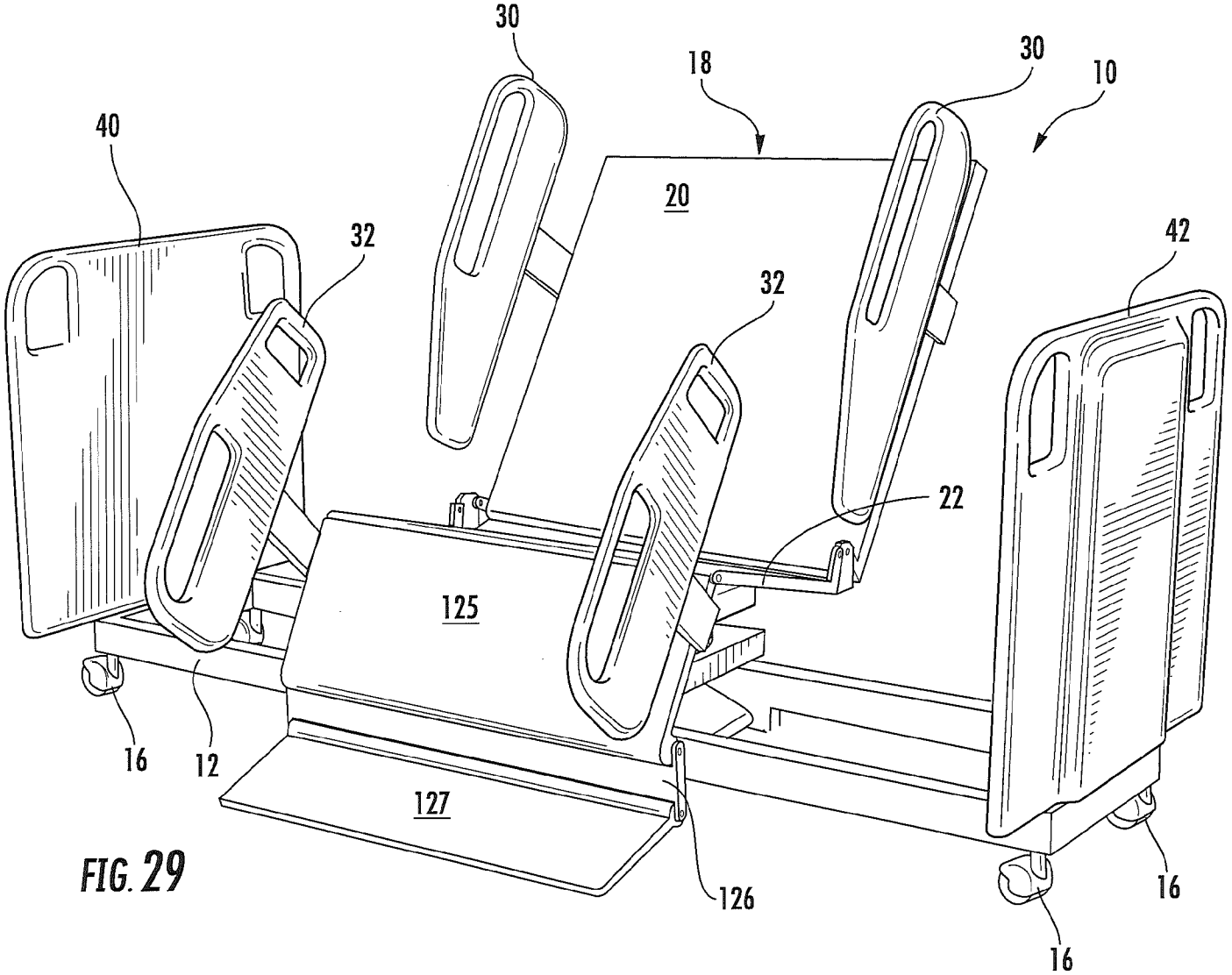

Once the back section 20 and seat section 22 are pivoted relative to each other and the foot section 24 and seat section 22 are pivoted relative to each other, the articulated patient support surface 18 can be rotated approximately ninety degrees (90°) to permit side egress from the bed 10, as illustrated in FIGS. 25-27. Once rotated approximately ninety degrees (90°) to permit side egress from the bed 10, the articulated patient support surface 18 can then be tilted as a unit, as illustrated in FIGS. 28-30, until the seat section 22 is substantially horizontal. At this point, the back section 20 may be substantially vertical.

Figure 34:
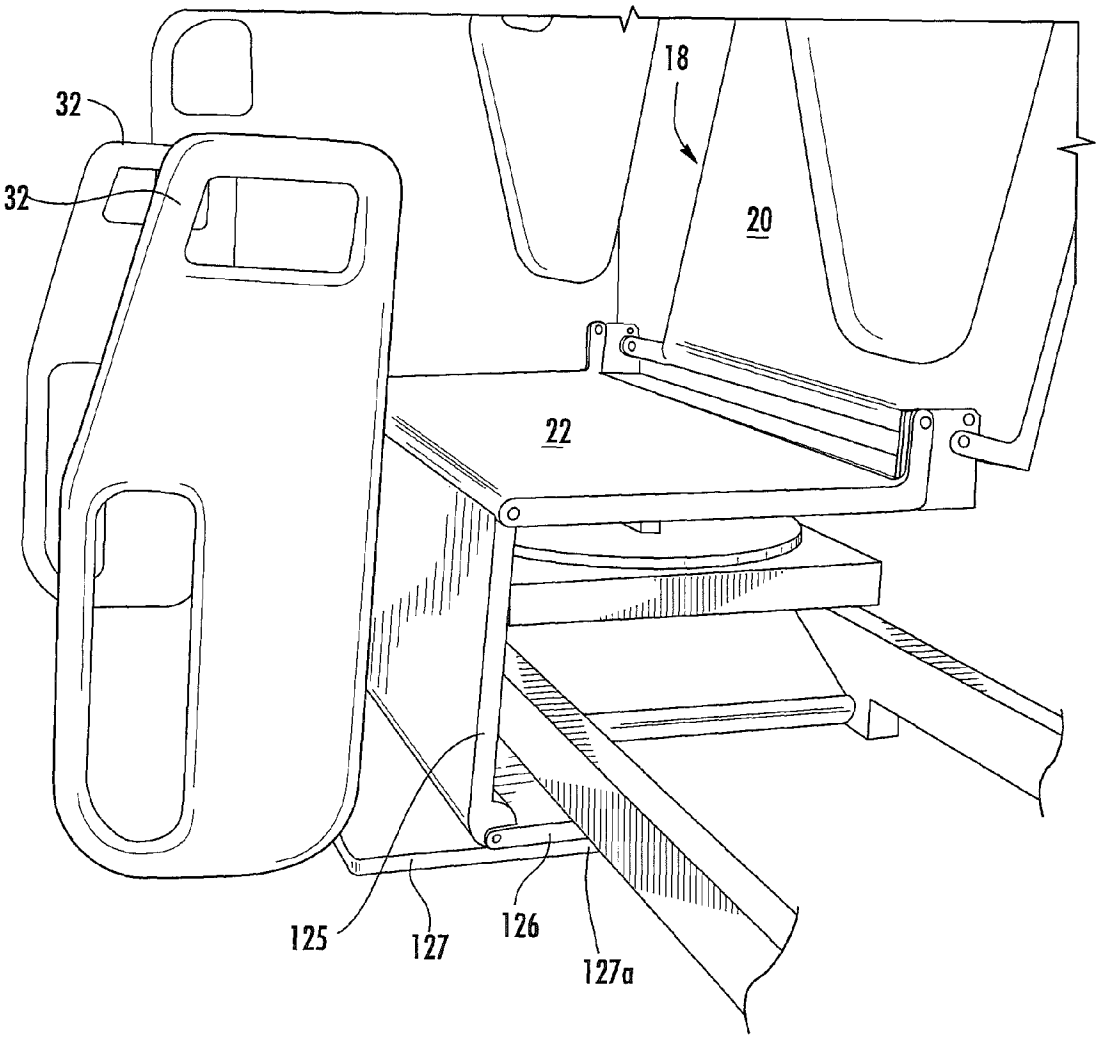

As the articulated patient support surface 18 is tilted, the first, second, and third panels 125, 126, 127 of the foot section 24 pivot relative to each other, as illustrated in FIGS. 31-34. Tilting of the articulated patient support surface 18 causes the first, second, and third panels 125, 126, 127 to pivot relative to each other such that the third panel 127 is substantially horizontal, the second panel 126 is in overlying, face-to-face contact with the third panel 127, and the first panel 125 is substantially vertical. This causes a rear portion 127*a* of the third panel 127 to extend under the base 12 of the bed, as illustrated in FIG. 34. As such, the third panel 127 is substantially out of the way of the feet of a patient who wishes to egress from the bed 10 and/or allows for the bed to accommodate a greater range of patient sizes to exit the bed while contacting the floor (e.g., short and tall patients).

The side rails 32, which can be secured to the foot section 24, rotate with the foot section 24 and are oriented such that a longitudinal direction thereof $A_1$ is substantially vertical (FIG. 30) when the bed is in a side egress position. The side rails 32 can be configured to be used as support handles to help a patient stand up from a sitting position on the support surface 18. The patient support surface 18 (e.g., the back and seat sections 20, 22) may then be raised and tilted forward, if necessary, to facilitate patient egress from the support surface 18 (e.g., a "stand-assist" orientation).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A method of translating a hospital bed to an egress configuration, comprising:

articulating back, seat and foot sections of a patient support surface relative to each other from a substantially coplanar configuration to a chair configuration, wherein the foot section comprises first and second panels that are translatable relative to each other; and translating the first and second foot section panels so that the first and second foot section panels are substantially orthogonal to each other and such that a first portion of the second panel extends under the first panel toward an interior space of a base of the bed and a second portion of the second panel smaller than the first portion resides forward of the first panel.

2. The method of claim 1, further comprising rotating the back, seat and foot sections 90 degrees to a side egress position prior to the translating step.

3. The method of claim 1, further comprising lifting the back and seat sections and titling the seat section downward at an angle of about 30 degrees or less relative to horizontal while the back section is substantially vertical to move the bed to a stand-assist egress configuration.

4. A method of translating a hospital bed to an egress configuration, comprising:

articulating back, seat and foot sections of a patient support surface relative to each other from a substantially coplanar configuration to a chair configuration, wherein the foot section includes first and second panels operably connected together; and translating the first and second foot section panels such that a first portion of the second panel extends under the first panel toward an interior space of a base of the bed and a second portion of the second panel smaller than the first portion resides forward of the first panel.

5. The method of claim 4, further comprising rotating the back, seat and foot sections 90 degrees to a side egress position prior to the translating step.

6. The method of claim 4, wherein the translating step comprises translating the first and second foot section panels to be substantially orthogonal to each other.

7. The method of claim 4, further comprising lifting the back and seat sections and tilting the seat section downward at an angle of about 30 degrees or less relative to horizontal while the back section is substantially vertical to move the bed to a stand-assist egress configuration.

8. The method of claim 4, further comprising rotating patient side rails with the back seat and foot sections then tilting the patient side rails down toward a floor.

* * * * *